US007651185B2

(12) United States Patent
Misumi

(10) Patent No.: US 7,651,185 B2
(45) Date of Patent: Jan. 26, 2010

(54) INKJET RECORDING APPARATUS AND INKJET RECORDING METHOD

(75) Inventor: Yoshinori Misumi, Minato-Ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 11/299,516

(22) Filed: Dec. 12, 2005

(65) Prior Publication Data

US 2006/0125853 A1 Jun. 15, 2006

(30) Foreign Application Priority Data

Dec. 15, 2004 (JP) ..... 2004-363598

(51) Int. Cl.
*B41J 29/38* (2006.01)

(52) U.S. Cl. ..... 347/12; 347/9; 347/5; 347/15; 347/40

(58) Field of Classification Search ..... 347/45, 347/6, 9, 12, 14, 15, 40, 41, 5
See application file for complete search history.

(56) References Cited

U.S. PATENT DOCUMENTS 6,799,824 B2 * 10/2004 Nunokawa ..... 347/15
2002/0105557 A1 * 8/2002 Teshigawara et al. ..... 347/15
2003/0067508 A1 4/2003 Mizutani
2005/0168531 A1 8/2005 Mizutani

FOREIGN PATENT DOCUMENTS

JP 2003-145775 A 5/2003

* cited by examiner

*Primary Examiner*—Matthew Luu
*Assistant Examiner*—Henok Legesse
(74) *Attorney, Agent, or Firm*—Canon USA Inc IP Div

(57) ABSTRACT

The invention provides an inkjet recording apparatus and an inkjet recording method that can reduce unevenness in the concentration that may appear on a recorded image due to a higher recording duty or other recording conditions. A recording head has first and second nozzle arrays discharging ink droplets. The first nozzle array discharges a relatively small droplet. The second nozzle array discharges a relatively large droplet. When a recording duty of a main recording scan performed by the recording head is equal to or greater than a predetermined value, a control unit controls the first nozzle array to stop discharging the small droplet and instead controls an end nozzle of the second nozzle array to discharge the large droplet to at least part of a designated dot forming position corresponding to an end nozzle of the first nozzle array.

6 Claims, 18 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method using an inkjet recording head that discharges or ejects ink droplets for recording or printing an image.

2. Description of the Related Art

The inkjet recording apparatus is advantageous because it is low in noise and running costs. Also, it is easy to downsize an apparatus body and can be used for color printing. Inkjet recording apparatuses are widely used for printers, copying machines, and facsimiles. In present inkjet recording apparatuses, ink droplets discharged from a recording head are smaller and therefore form a small dot that can reduce the granularity on a recorded or printed image. Especially, the present recording heads tend to discharge small droplets of color inks. In recent years, the droplet size has decreased from 15 pl to 5 pl or to 2 pl.

Meanwhile, highly advanced digital input devices are widely used for high-quality images. The inkjet recording apparatuses are thus required to output high-quality images comparable with the images entered from the digital input devices. From these circumstances, in consideration of the matching with the advanced input devices, the inkjet recording apparatuses must be sufficiently reliable for realizing small droplets and the nozzle opening diameter of a recording head must be reduced in accordance with the droplet size.

However, as the ink droplet becomes smaller, the kinetic energy of a droplet becomes smaller. The droplet is easily affected by the surroundings. For example, when an ink droplet is discharged at a high density, i.e., when a recording operation is performed at a higher recording duty, an air stream generated around a recording head possibly bends a flying direction of an ink droplet. More specifically, the flying direction of an ink droplet discharged from an edge portion of a nozzle array of the recording head is offset or deviated toward the center of the nozzle array under the influence of air stream. Accordingly, the ink impact position deviates from an intended position on a recording medium. The phenomenon appears significantly at an edge portion of a nozzle array of the recording head.

To solve such an impact deviation, Japanese Patent Application Laid-open No. 2003-145775 (corresponding to US Patent Application No. 2003-067508) discloses a wide clearance between an endmost nozzle (i.e., a nozzle positioned at an endmost portion of a nozzle array provided on a recording head) and a neighboring nozzle. Providing a wide clearance between the endmost and neighboring nozzles enables for correction of the impact position of an ink droplet which is forcibly shifted toward the center of the nozzle array due to an air stream generated during a high recording duty operation.

However, the correcting method proposed in Japanese Patent Application Laid-open No. 2003-145775 is based on an assumption that the impact position of an ink droplet discharged from the edge portion of a nozzle array is greatly offset or deviated during a high recording duty operation. Therefore, this method is practically used only for a high recording duty operation. If the recording duty is low, this method will cause an unexpected counter-deviation of an ink droplet discharged from the edge portion of a nozzle array. More specifically, when an image is formed in a low recording duty, an air stream is hardly generated. An ink droplet discharged from the edge portion of a nozzle array is not so affected by the air stream.

Hence, the flying direction of an ink droplet does not bend as much. As a result, the impact position of an ink droplet deviates from an intended position by an amount equivalent to a widened pitch between the endmost and neighboring nozzles. Such a counter-deviation of the impact position appears as unevenness of concentration on an image. Especially, in speedy recording operations in a single- or 2-pass mode, the unevenness of concentration appears as a black streak along the boundary of lines. As a result, the image quality deteriorates.

The unevenness of concentration will be described in more detail. It is now assumed that a recording head is scanned twice to record the data of a head width. For the above scanning operation, a recording head is used in which an amount of an ink droplet is 1.5 pl, a nozzle alignment density is 1200 dpi, a total nozzle number is 256, and a width in a nozzle alignment direction is 0.21 inches. In this case, in order to form an image on a recordable region (8×11 inches) of an A4-size recording medium, the scanning of the recording head must be repeated approximately 104 times. The recording head is driven at a drive frequency of 30 kH (that is, a moving speed of the recording head is 25 inch/sec).

When the recording duty is high, i.e. approximately 50% or above, the flying direction of an ink droplet discharged from the edge portion of a nozzle array of the recording head undesirably bends toward the center of the nozzle array due to the effect of an air stream. As a result, the impact position of the ink droplet discharged from the edge portion of the nozzle array is offset or deviated toward the center of the nozzle array. However, the nozzle pitch at the edge portion of a nozzle array is widened beforehand as described above. Thus, a deviation amount of the ink droplet is canceled by the wide nozzle pitch. As a result, the impact position of an ink droplet becomes correct and no streak appears on the boundary between each line.

On the other hand, when the recording duty is reduced to approximately 50% or less, an air stream is hardly generated around the recording head even if the recording is performed using the same recording head under the same recording conditions. Accordingly, the deviation amount of an ink droplet discharged from the edge portion of a nozzle array is small. In this case, due to the wide nozzle pitch at the edge portion of a nozzle array, the dots formed by the ink droplets discharged from the end nozzles are overlapped with each other. Accordingly, a black streak appears on the boundary between each line.

SUMMARY OF THE INVENTION

The present invention is directed to an inkjet recording apparatus that can reduce unevenness in the concentration that may be caused by an air stream generated around a recording head.

The present invention is also directed to an inkjet recording method.

A first aspect of the present invention provides an inkjet recording apparatus operable to record on a recording medium and having a recording unit operable to discharge a small ink droplet and a large ink droplet larger than the small ink droplet. The inkjet recording apparatus includes a moving mechanism operable to move the recording unit in a main scanning direction relative to the recording medium, and a control unit controlling the recording unit to discharge large ink droplets to at least part of a designated discharge position of small ink droplets to be discharged to a raster positioned at an end portion of a band, the band including of a plurality of rasters formed on the recording medium by moving the recording unit in the main scanning direction.

A second aspect of the present invention provides an inkjet recording apparatus having a recording unit and effecting recording for every band on a recording medium by moving the recording unit in a main scanning direction relative to the recording medium, the recording unit discharging a small ink droplet and a large ink droplet larger than the small ink droplet. The inkjet recording apparatus includes a counting unit counting a number of ink droplets to be discharged to a single band having a plurality of rasters, a control unit controlling the recording unit to discharge large ink droplets to at least part of a designated discharge position of small ink droplets to be discharged to a raster positioned at an end portion of the single band, and a determining unit determining, based on a count value obtained by the counting unit, whether or not a discharge control of the control unit is executed.

A third aspect of the present invention provides an inkjet recording apparatus having a recording unit and effecting recording for every band on a recording medium by moving the recording unit in a main scanning direction relative to the recording medium, the recording unit discharging a small ink droplet and a large ink droplet larger than the small ink droplet. The inkjet recording apparatus includes a counting unit configured to count a number of ink droplets to be discharged for a single band having of a plurality of rasters, a determining unit determining whether or not a count value obtained by the counting unit exceeds a predetermined threshold, and a control unit controlling the recording unit to discharge large ink droplets to at least part of a designated discharge position of small ink droplets to be discharged to a raster positioned at an end portion of the single band, based on the count value exceeding the predetermined threshold.

A fourth aspect of the present invention provides an inkjet recording apparatus for effecting recording on a recording medium including a recording unit including first and second nozzle arrays, the first nozzle array including a plurality of first nozzles aligned in a predetermined direction to discharge a small ink droplet, and the second nozzle array including a plurality of second nozzles aligned in the predetermined direction to discharge a large ink droplet larger than the ink droplet of the first nozzle. The inkjet recording apparatus includes a moving mechanism configured to move the recording unit in a direction intersecting with the predetermined direction to discharge the small and large ink droplets on the recording medium from the first and second nozzles, and a control unit controlling the recording unit to discharge the large ink droplet from an end nozzle of the second nozzle array to at least part of a designated dot forming position of an end nozzle of the first nozzle array, instead of discharging the small ink droplet from the end nozzle of the first nozzle array.

A fifth aspect of the present invention provides an inkjet recording apparatus for effecting recording on a recording medium includes a recording unit including first and second nozzle arrays, the first nozzle array including a plurality of first nozzles aligned in a predetermined direction to discharge a small ink droplet, and the second nozzle array including a plurality of second nozzles aligned in the predetermined direction to discharge a large ink droplet larger than the small ink droplet of the first nozzle. The inkjet recording apparatus includes a moving mechanism configured to move the recording unit in a direction intersecting with the predetermined direction to discharge the small and large ink droplets on the recording medium from the first and second nozzles, a judging unit judging whether or not a recording dot number in a single main scan performed by the recording head exceeds a predetermined threshold, and a control unit controlling the recording unit to discharge the large ink droplet from an end nozzle of the second nozzle array to at least part of a designated dot forming position of an end nozzle of the first nozzle array, instead of discharging the small ink droplet from the end nozzle of the first nozzle array, when the recording dot number exceeds the threshold.

A sixth aspect of the present invention provides a method for performing an inkjet recording operation, including the steps of moving a recording unit in a main scanning direction relative to a recording medium for effecting recording on the recording medium, the recording unit discharging a small ink droplet and a large ink droplet larger than the small ink droplet, and discharging large ink droplets to at least part of a designated discharge position of small ink droplets to be discharged to a raster positioned at an end portion of a band, the band having of a plurality of rasters formed on the recording medium by moving the recording unit in the main scanning direction.

A seventh aspect of the present invention provides a method for performing an inkjet recording operation for every band on a recording medium by moving a recording unit in a main scanning direction relative to the recording medium, the recording unit discharging a small ink droplet and a large ink droplet larger than the small ink droplet, including the steps of counting the number of ink droplets to be discharged to a single band having a plurality of rasters, judging whether or not the number of ink droplets counted in the counting step exceeds a predetermined threshold, and discharging large ink droplets to at least part of a designated discharge position of small ink droplets to be discharged to a raster positioned at an end portion of the single band, responsive to the counted number of ink droplets exceeding the predetermined threshold.

An eighth aspect of the present invention provides a method for performing an inkjet recording operation, including the steps of, moving a recording unit in a direction intersecting with an alignment direction of nozzles of the recording unit to discharge ink droplets on a recording medium from the nozzles, the recording unit including first and second nozzle arrays, the first nozzle array including a plurality of first nozzles discharging a small ink droplet, and the second nozzle array including a plurality of second nozzles discharging a large ink droplet larger than the ink droplet of the first nozzle, judging whether or not a recording dot number in a single main scan performed by the recording head exceeds a predetermined threshold, and discharging the large ink droplet from an end nozzle of the second nozzle array to at least part of a designated dot forming position of an end nozzle of the first nozzle array, instead of discharging the small ink droplet from the first nozzle array, when the recording dot number exceeds the threshold.

A ninth aspect of the present invention provides a method for performing an inkjet recording operation, including the steps of moving a recording unit in a direction intersecting with an alignment direction of nozzles of the recording unit to discharge ink droplets on a recording medium from the nozzles, the recording unit including first and second nozzle arrays, the first nozzle array including a plurality of first nozzles discharging a small ink droplet, and the second nozzle array including a plurality of second nozzles discharging a large ink droplet larger than the ink droplet of the first nozzle, judging whether or not a recording dot number in a single main scan of the first nozzle array exceeds a predetermined threshold, and discharging the large ink droplet from an end nozzle of the second nozzle array to at least part of a designated dot forming position of an end nozzle of the first nozzle array, instead of discharging the small ink droplet from the first nozzle array, when the recording dot number exceeds the threshold.

According to the above-described inkjet recording apparatus and inkjet recording method, an image of an end portion of each recording region is formed with large dots, instead of using small dots. Thus, the impact deviation of ink droplets that may be caused by an air stream can be reduced. As a result, unevenness in the concentration appearing along the boundary of recording regions formed by the recording scanning operation can be reduced. The quality of an entire image can be improved.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 14A shows an edge raster formed by small dots on a recording medium.

FIG. 14B shows an edge raster formed by large dots on a recording medium.

DETAILED DESCRIPTION OF THE EMBODIMENTS

Figure 1:
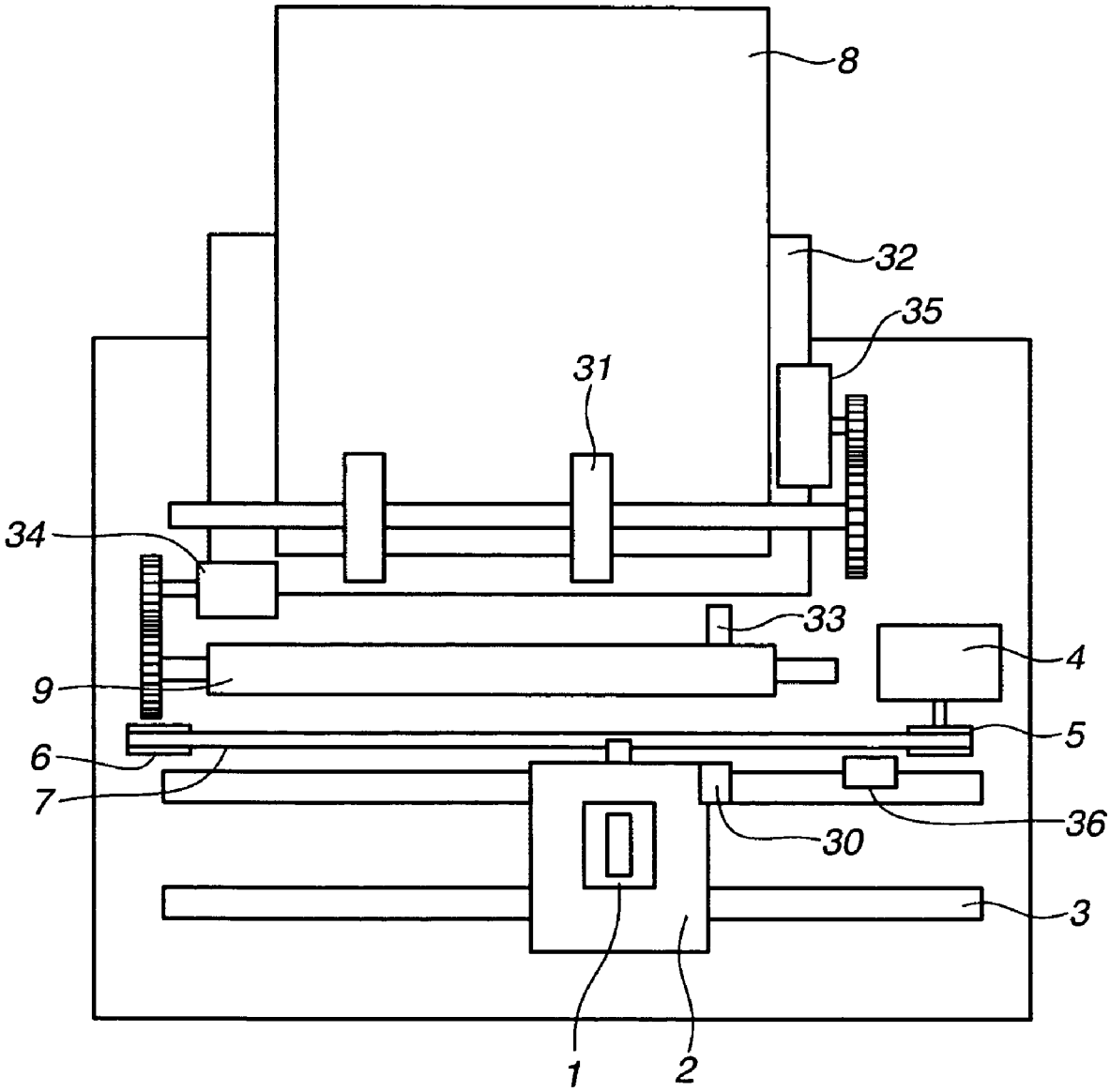
FIG. 1 is a schematic view showing an inkjet recording apparatus in accordance with an embodiment of the present invention.

Embodiments of the invention will be described in detail below with reference to the drawings.

A first embodiment of the present invention performs the following processing when an image is formed on a recording medium with a recording head.

(1) The first embodiment of the present invention uses a recording head which discharges droplets of different amounts. The recording head includes a nozzle array consisting of nozzles discharging a relatively small droplet and another nozzle array consisting of nozzles discharging a relatively large droplet. The latter nozzle array discharges large droplets to a small dot forming position which is designated for a droplet discharged from an end nozzle of the former nozzle array.

(2) When a recording duty in a recording scanning region is greater than a predetermined threshold, a large nozzle discharging a large droplet forms a large dot at a small dot forming position designated for a droplet from an end nozzle discharging a small droplet.

With the above operations, a high-quality image free from unevenness of concentration can be recorded even in a single-pass or low-pass recording operation.

The inventor of the present invention evaluated the above-described processes (1) and (2), and confirmed a deviated impact position of a discharged droplet in relation to a droplet size and a recording duty. More specifically, the dot impact condition on a recording medium was determined every time the droplet size and/or the recording duty of the recording head are changed. When a small droplet (approximately 1.5 pl according to the present embodiment) was discharged at a high duty (approximately 50% or above), a droplet discharged from an edge portion of a nozzle array was conveyed toward the center of the nozzle array by an air stream. A white streak appeared on the boundary between lines (i.e., scanned regions) due to the deviation of impact dots.

Hence, instead of discharging a small droplet (1.5 pl) from an endmost or neighboring nozzle, a large droplet (5 pl according to the present invention) was discharged to form a dot of an image. A large droplet (5 pl) is less affected by an air stream, compared with a small droplet, and accordingly, an impact deviation caused by an air stream is relatively small. Moreover, a large droplet dot has a large impact area, and accordingly, even if an impact deviation is caused, a white streak will be hardly formed between the dots. Therefore, when a small droplet dot is replaced with a large droplet dot, the probability of occurrence of a white streak can be theoretically reduced. In order to confirm the effect of such a dot replacement in reducing a white streak, a person having eyesight of 1.0 to 1.5 in both eyes checked an obtained image from a position spaced approximately 20 cm from a recording medium. According to the checked result, no noticeable white streak was found on the image.

Although the small droplet size is 1.5 pl and the large droplet size is 5 pl in the above description, the discharge amounts of the small and large droplets used in the present invention are not limited to the described values. Regardless of the discharge amounts of the small and large droplets, the effect in reducing a white streak can be produced by replacing a small droplet dot with a large droplet dot.

As described above, according to the present invention, unevenness of concentration can be greatly reduced even if droplets discharged from an end nozzle of a nozzle array are deviated.

First Embodiment

<Schematic Arrangement of Inkjet Recording Apparatus>

An inkjet recording apparatus in accordance with a first embodiment of the present invention is illustrated referring to the drawings.

FIG. 1 shows an essential arrangement of the inkjet recording apparatus of the first embodiment.

An exchangeable recording head cartridge 1 is mounted on a carriage 2. The recording head cartridge 1 has a recording head and an ink tank section. The recording head cartridge 1 includes a connector (not shown) for receiving a signal to drive a recording head. The carriage 2 includes a connector holder (i.e., electric connecting portion, not shown) for transmitting a drive signal to the recording head cartridge 1 via the connector.

The carriage 2 is supported movable in a main scanning direction along a guide shaft 3 extending in an apparatus body. The carriage 2 is driven by a main scanning motor 4 via a drive mechanism including a motor pulley 5, a driven pulley 6, and a timing belt 7. The main scanning motor 4 controls the positioning and moving of the carriage 2. The carriage 2 is equipped with a home position sensor 30. The home position sensor 30 is movable together with the carriage 2. The home position sensor 30 generates a detection signal when the home position sensor 30 passes by a shield plate 36 provided at a predetermined reference position on a moving path of the carriage 2. The position of the shield plate 36 that is detected by the home position sensor 30 is defined as a home position (i.e., reference position) in the moving path of the carriage 2.

A recording medium 8, such as a printing paper or a plastic thin plate, is placed on a paper feeding tray of an automatic sheet feeder (hereinafter, referred to as ASF) 32. The ASF 32 is equipped with a paper feeding motor 35 that rotates a pickup roller 31 via a couple of gears. In accordance with rotation of the pickup roller 31, the recording medium 8 is forwarded or supplied from the paper feeding tray to carrier rollers 9 provided in the recording apparatus body. The recording medium 8 is then conveyed by the carrier rollers 9 and passes a position (i.e., printing portion) where the recording medium 8 is opposed to a nozzle face of the recording head cartridge 1. The carrying action in this direction is referred to as a sub scan.

The carrier rollers 9 are driven (i.e., rotated) by an LF motor 34 via a couple of gears. A judgment whether or not the paper feeding operation is accomplished, and locating the beginning of the recording medium 8 when it is being fed, is performed at the timing that the recording medium 8 has passed the paper end sensor 33. The paper end sensor 33 is also used to detect an actual position of the trailing edge of the recording medium 8 and to estimate a present recording position based on the detected trailing edge position of the recording medium 8.

The back of the recording medium 8 is supported by a platen (not shown) so that the recording medium 8 can form a flat printing surface at the printing portion. When the recording head cartridge 1 is mounted on the carriage 2, the nozzle face of the recording head cartridge 1 protrudes downward from the carriage 2. The nozzle face is positioned in parallel with the recording medium 8 which is sandwiched between the pair of carrier rollers 9.

The recording head is, for example, an inkjet type that discharges ink droplets from a group of nozzles. The recording head is equipped with electrothermal converters (i.e., energy generating units) that generate thermal energy for discharging or ejecting an ink droplet. The thermal energy generated by the electrothermal converter causes film boiling accompanied by bubbles. The recording head utilizes the pressure of bubbles to discharge the ink from the nozzle and perform printing. The present embodiment is, however, applicable to other recording head that may use piezoelectric elements and the like to discharge the ink.

<Recording Head Cartridge>

Figure 2B:
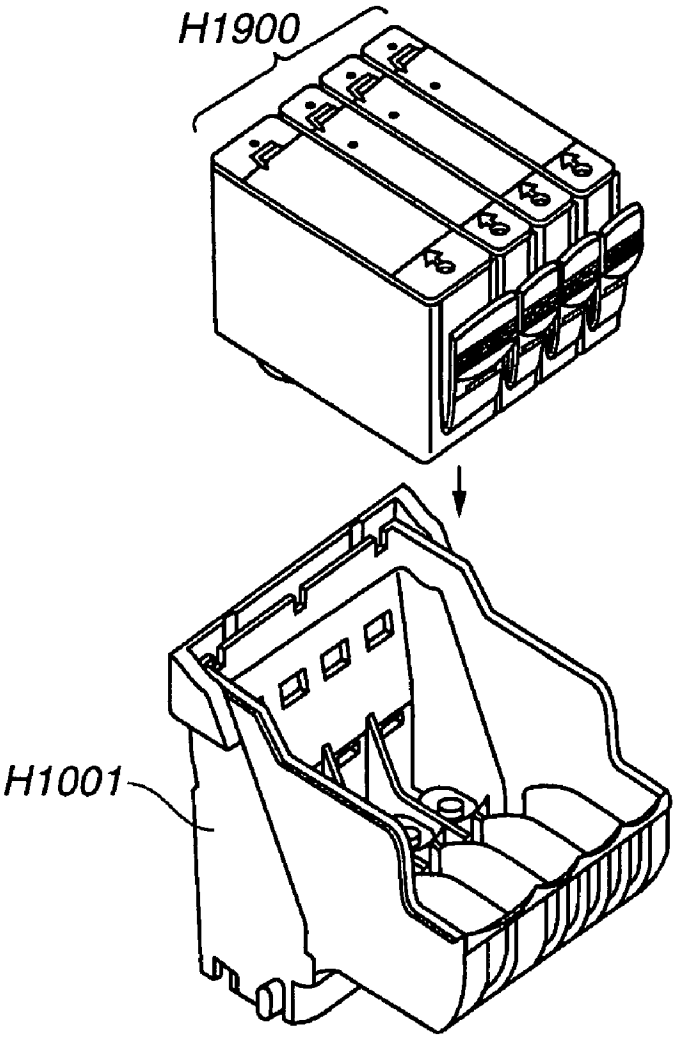
FIG. 2B is a perspective view showing the recording head cartridge of the inkjet recording apparatus in accordance with the embodiment of the present invention, when the ink tank is removed.
Figure 2A:
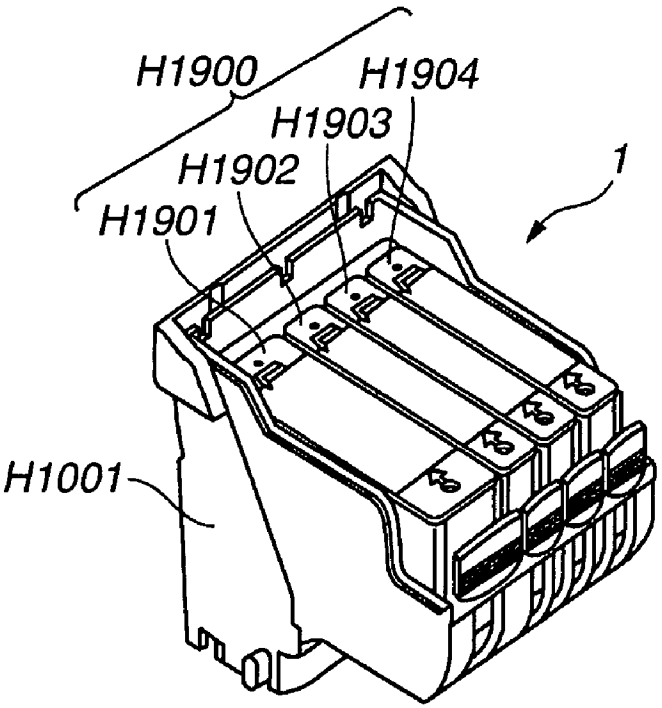
FIG. 2A is a perspective view showing a recording head cartridge of the inkjet recording apparatus in accordance with the embodiment of the present invention, when an ink tank is attached.
Figure 10:
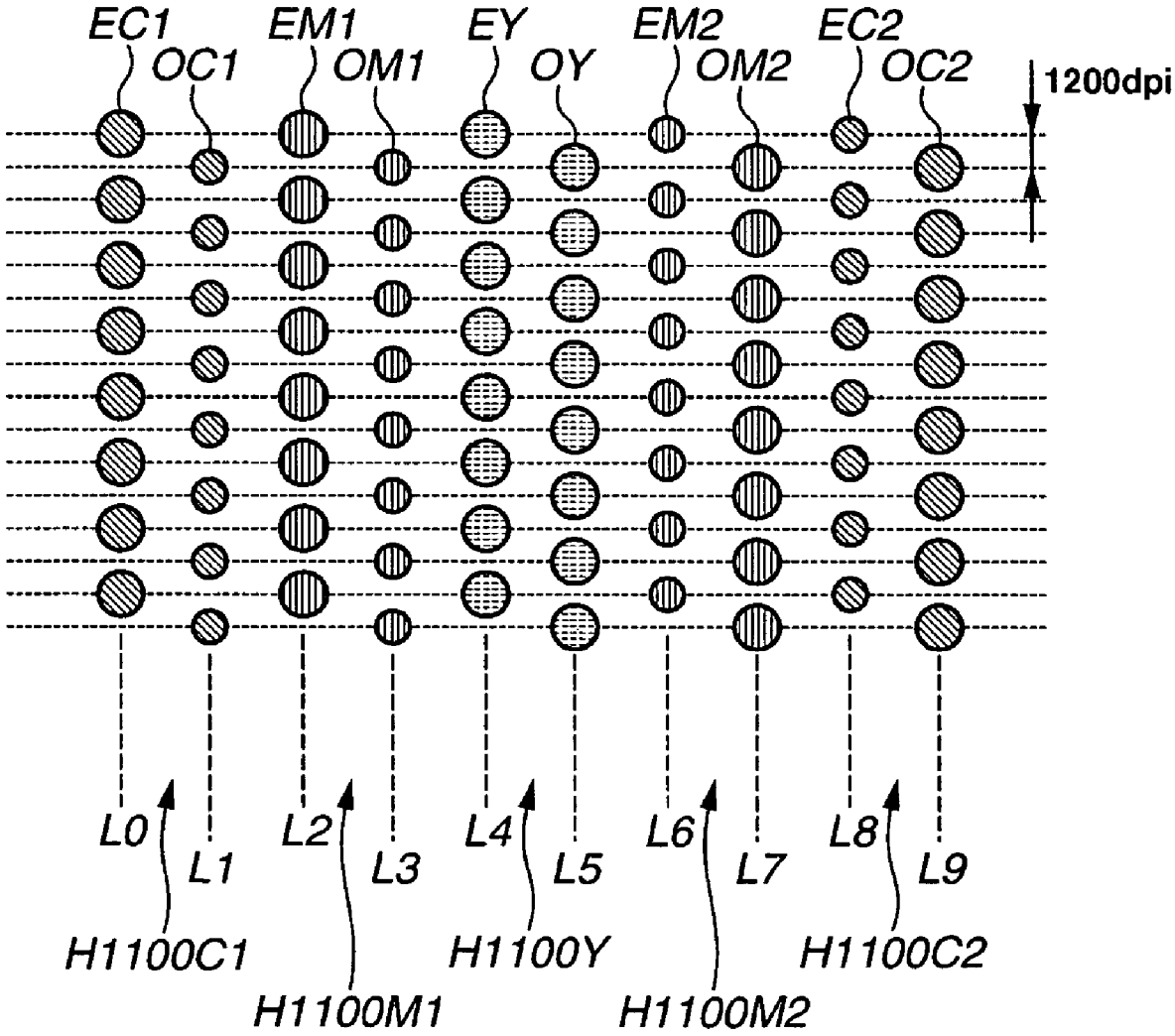
FIG. 10 is an enlarged plan view showing the recording element substrate according to the embodiment of the present invention, seen from the nozzle group.

FIGS. 2A, 2B, and 10 show a recording head cartridge of the present embodiment.

FIGS. 2A and 2B show the recording head cartridge 1 embodying the present invention. FIG. 2A is a perspective view showing a recording head H1001 and an ink tank H1900 of the recording head cartridge 1. FIG. 2B shows the recording head cartridge 1 when the ink tank H1900 is not attached to the recording head H1001.

The recording head cartridge 1 includes the recording head H1001 and the ink tank H1900. The ink tank H1900 is detachably attached to the recording head H1001. The recording head cartridge 1 is detachably mounted on the carriage 2 which is provided in the inkjet recording apparatus body. A positioning unit (not shown) holds the recording head cartridge 1 at a predetermined position when the recording head cartridge 1 is mounted on the carriage 2. The recording head cartridge 1 is electrically connected to the carriage 2 via electric contacts, when the recording head cartridge 1 is attached to the carriage 2.

The ink tank H1900 is composed of four ink tanks H1901 to H1904. The ink tank H1901 is for black ink. The ink tank H1902 is for cyan ink. The ink tank H1903 is for magenta ink. The ink tank H1904 is for yellow ink. Each of the ink tanks H1901, H1902, H1903, and H1904 is independently attachable to or detachable from the recording head H1001. Thus, respective ink tanks are individually replaceable. This arrangement enables timely replacement of the ink tank H1900 without wasting the ink. The running cost for the recording operation performed by the ink jet recording apparatus can be reduced.

The recording head H1001 has the following constituent components.

(1) Recording Head

The recording head H1001 is a bubble jet recording head that includes electrothermal converters each generating thermal energy which causes the film boiling of the ink in response to an electric signal. The electrothermal converter opposes a discharge port of the ink. The recording head having such an arrangement is generally referred to as a side shooter type.

Figure 3:
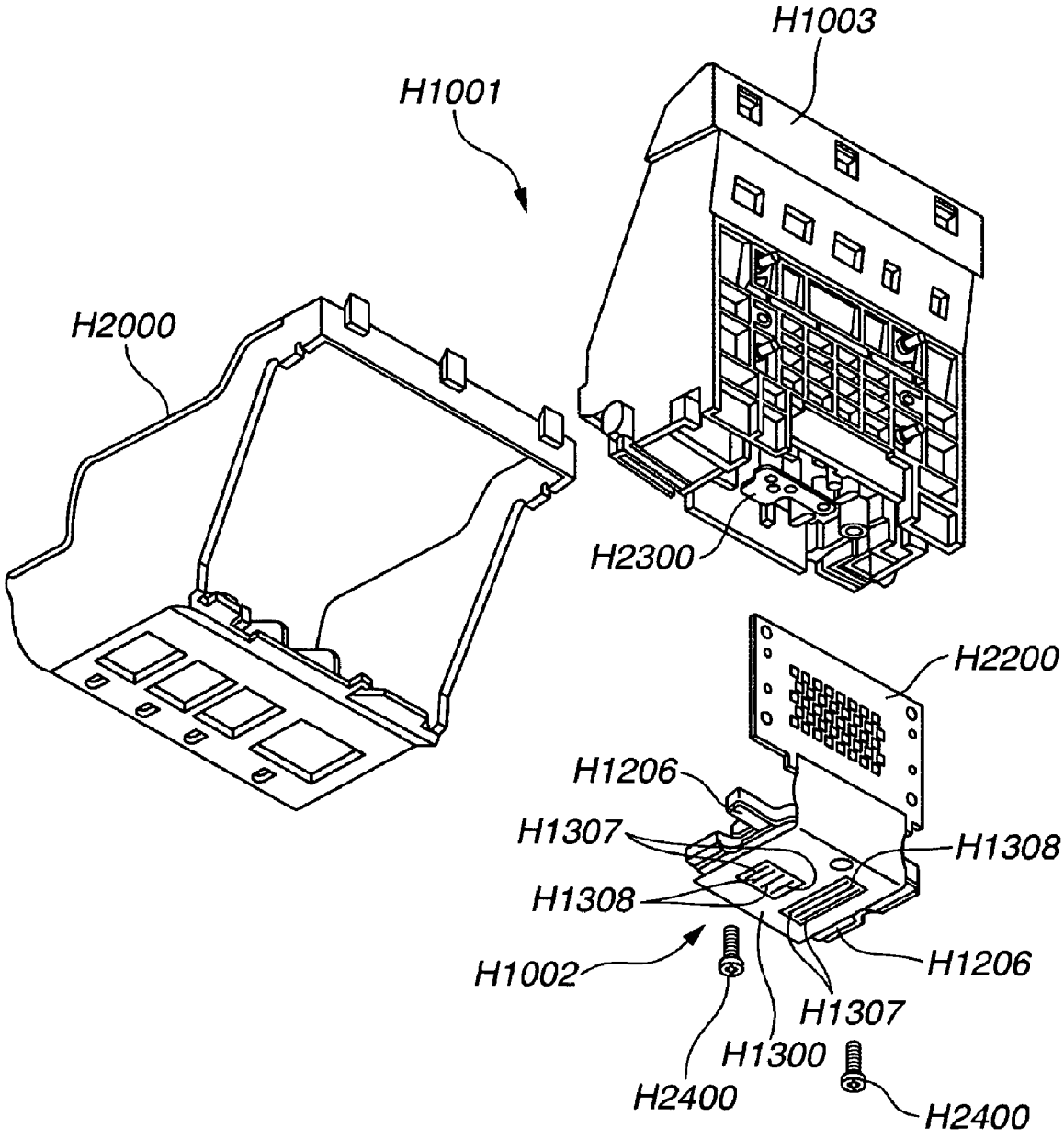
FIG. 3 is an exploded perspective view showing a recording head of the recording head cartridge shown in FIGS. 2A and 2B.

The recording head H1001 includes a recording element unit H1002, an ink supply unit (i.e., liquid supply unit) H1003, and a tank holder H2000 as shown in an exploded perspective view of FIG. 3.

Figure 4:
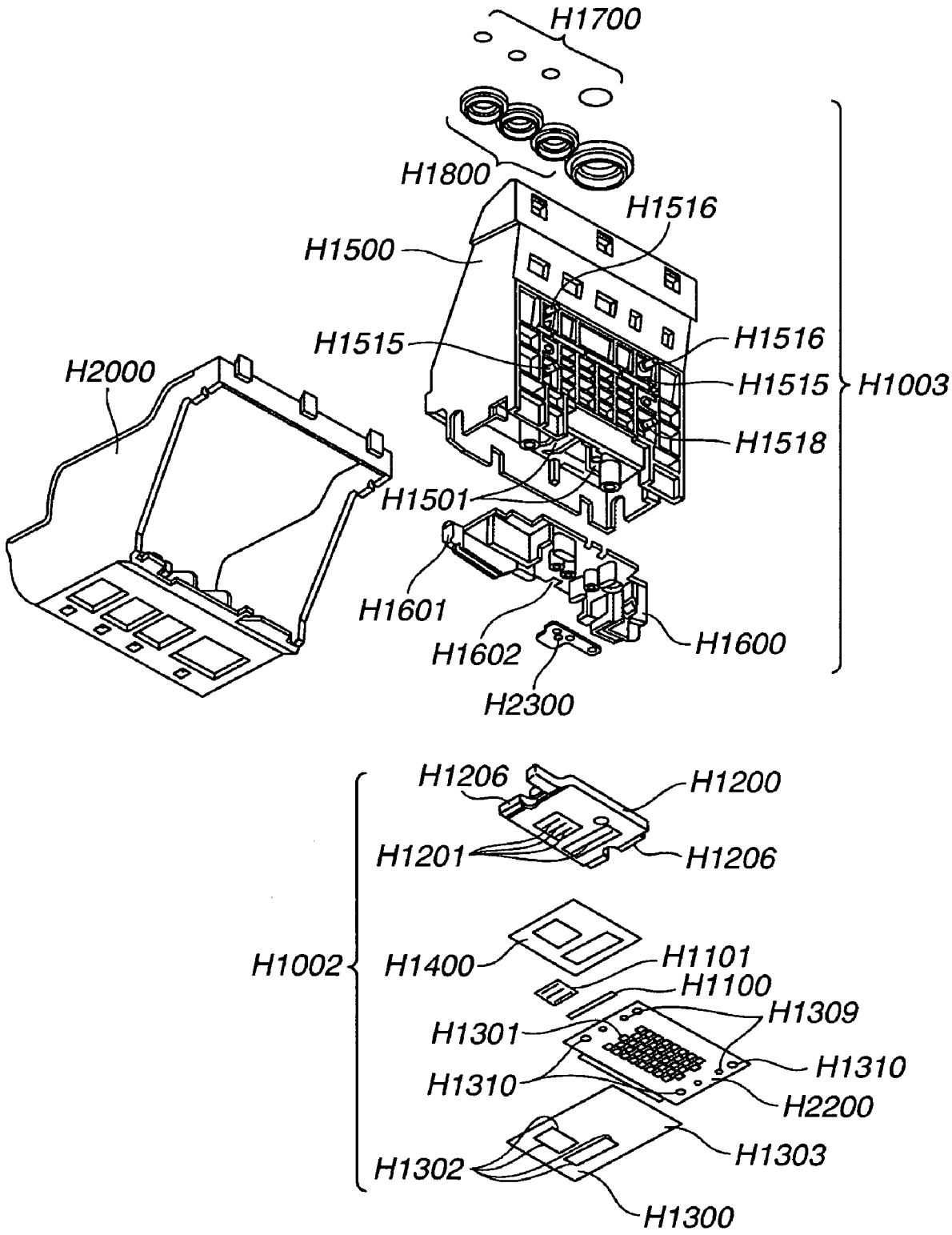
FIG. 4 is a detailed exploded perspective view showing the recording head of the recording head cartridge shown in FIGS. 2A and 2B.

The recording element unit H1002 includes a first recording element substrate H1100, a second recording element substrate H1101, a first plate H1200, an electric wiring tape (i.e., electric wiring substrate) H1300, an electric contact substrate H2200, and a second plate H1400, as shown in an exploded perspective view of FIG. 4. The ink supply unit H1003 includes an ink supply member H1500, a fluid passage forming member H1600, a joint seal member H2300, a filter H1700, and a seal rubber H1800.

(1-1) Recording Element Unit

The first plate H1200 is, for example, made from an alumina (Al2O3) material having the thickness of about 0.5 mm to 10 mm. The material used for the first plate H1200 is not limited to the alumina. For example, other materials can be used that have a linear expansion coefficient substantially equal to that of the recording element substrate material and has a thermal conductivity equal to or greater than that of the recording element substrate material. More specifically, the material for the first plate H1200 can be selected from any one of silicon (Si), aluminum nitride (AlN), zirconia, silicon nitride (Si3N4), silicon carbide (SiC), molybdenum (Mo), and tungsten (W).

The first plate H1200 has an ink supply port H1201 including a supply port for supplying black ink to the first recording element substrate H1100 and other supply ports for supplying cyan, magenta, and yellow inks to the second recording element substrate H1101. The first plate H1200 has two screw-fastening portions H1206 formed at both ends. The first plate H1200 is connected to the ink supply unit H1003 by means of screws fastened into the screw-fastening portions H1206.

Figure 5:
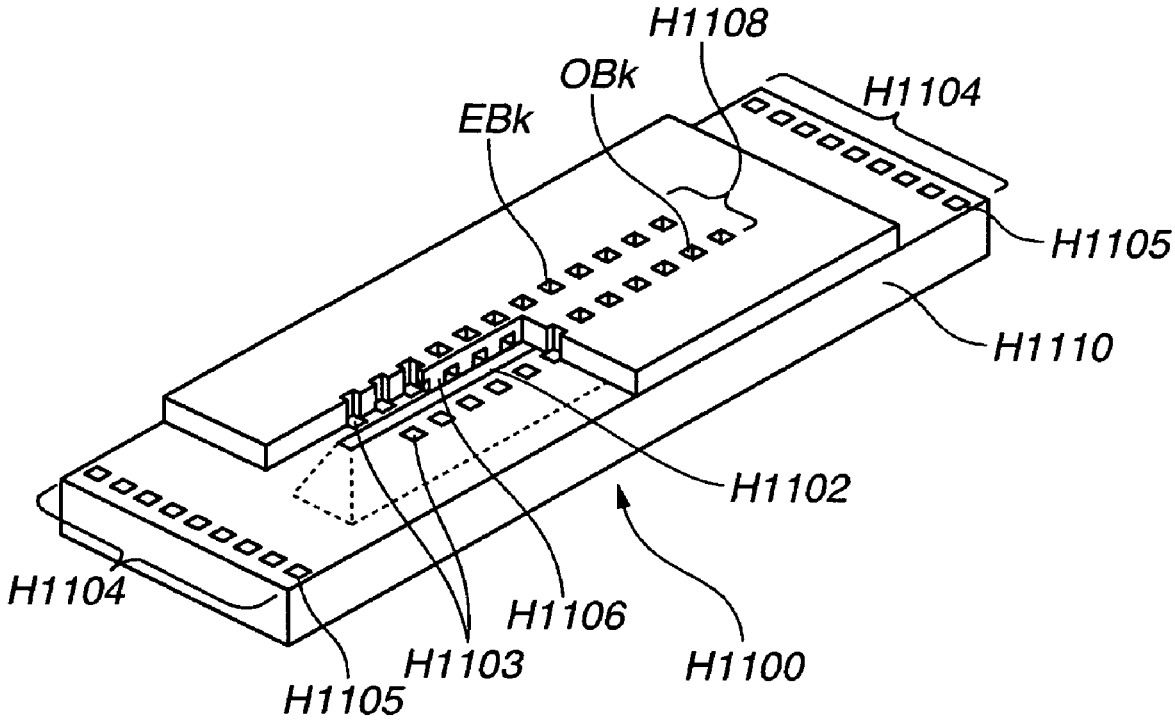
FIG. 5 is a partly-broken perspective view showing a first recording element substrate of the recording head cartridge shown in FIGS. 2A and 2B.

FIG. 5 is a partly-broken perspective view showing the arrangement of the first recording element substrate H1100 for the black ink. The first recording element substrate H1100 includes an ink supply port H1102 that is formed, for example, on a Si substrate H1110 having the thickness of about 0.5 mm to 1 mm. The ink supply port H1102 is an ink fluid passage in the shape of an elongated groove. A pair of arrays of electrothermal conversion elements H1103 is disposed along the ink supply port H1102 on both sides of the port H1102. Electric power is supplied to respective electrothermal conversion elements H1103 via an Al electric wiring (not shown).

The electrothermal conversion elements H1103 and the electric wiring are formed according to a film-forming technique. The electrothermal conversion elements H1103 are disposed on the substrate H1100 in a staggered fashion. The nozzles OBk and EBk corresponding to the electrothermal conversion elements H1103 are mutually offset so as not to be positioned on the same line perpendicular to the array direction of the electrothermal conversion elements H1103. A pair of electrode portions H1104 that supply electric power to the electric wiring, is formed along both short sides of the substrate H1100. A predetermined number of Au bumps H1105 are aligned on each electrode portion H1104.

An ink fluid passage wall H1106 defining the ink fluid passage corresponding to the electrothermal conversion elements H1103 and a ceiling portion covering the ink fluid passage are integrally provided on the Si substrate H1110. The ceiling portion is constructed of a structural body made of a resin material. A predetermined number of nozzles OBk and EBk are formed in the ceiling portion using a photolithographic technique. The nozzles OBk and EBk cooperatively constitute a nozzle group H1108. The nozzles OBk and EBk are opposed, in a one-to-one relationship, to the electrothermal conversion elements H1103. When the electrothermal conversion element H1103 of the first recording element H1100 generates a bubble pressure by heat, the ink supplied from the ink fluid passage H1102 is discharged or ejected from the nozzle opposed to the electrothermal conversion element H1103.

Figure 6:
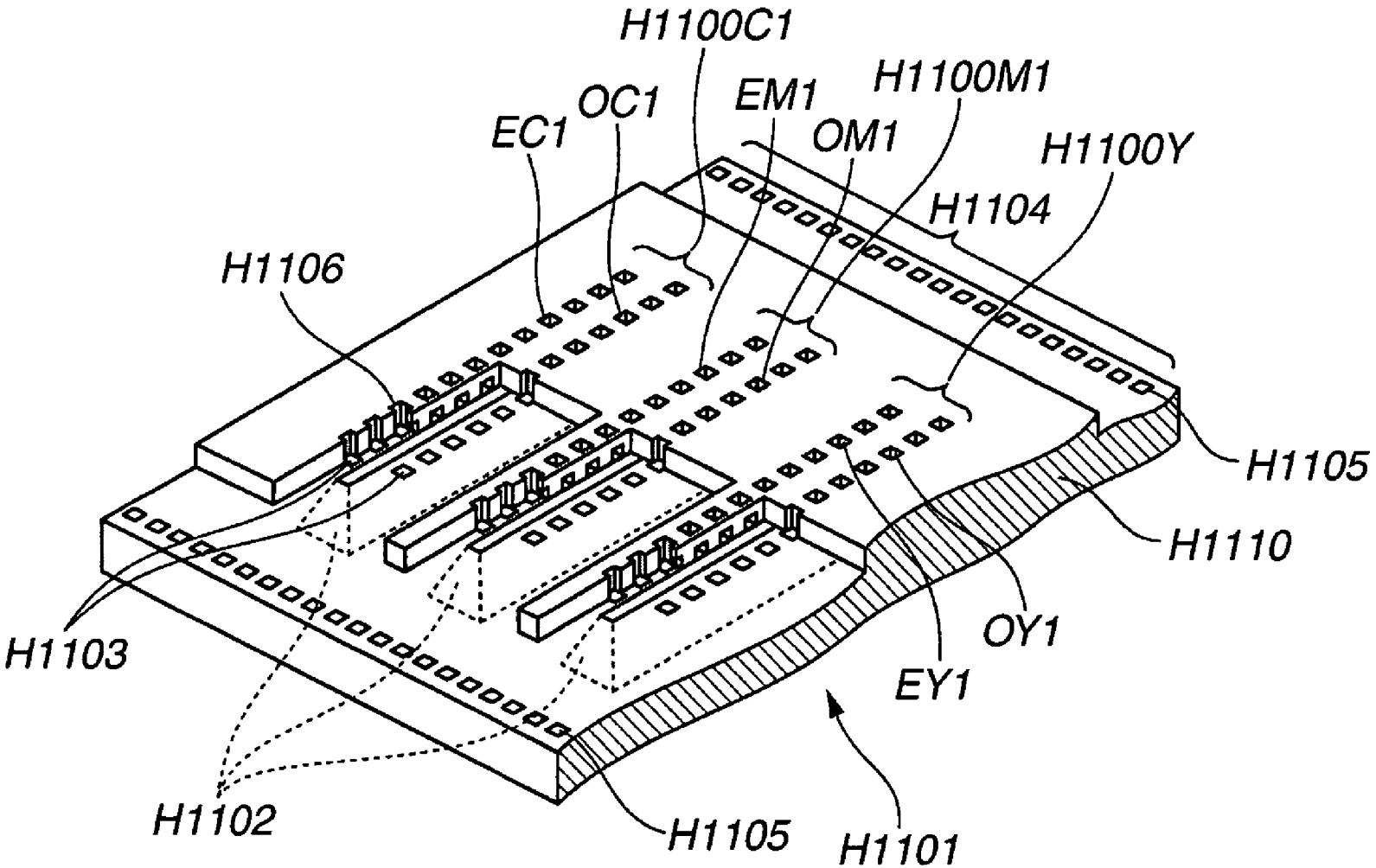
FIG. 6 is a partly-broken perspective view showing a second recording element substrate of the recording head of the recording head cartridge shown in FIG. 3.

FIG. 6 is a partly-broken perspective view showing a detailed arrangement of the second recording element substrate H1101. The second recording element substrate H1101 is for discharging or ejecting three color inks, i.e., cyan, magenta, and yellow. A total of six ink supply ports H1102 are formed in parallel to each other, although FIG. 6 shows only three ink supply ports H1102. A predetermined number of electrothermal conversion elements H1103 and nozzles are disposed on both sides of each ink supply port H1102 in a staggered fashion. Two parallel arrays of nozzles EC1 and OC1, disposed along and on both sides of the ink supply port H1102, cooperatively constitute a nozzle group H1100C1. Similarly, two parallel arrays of nozzles EM1 and OM1 cooperatively constitute a nozzle group H1100M1. Two parallel arrays of nozzles EY1 and OY1 cooperatively constitute a nozzle group H1100Y.

Figure 9:
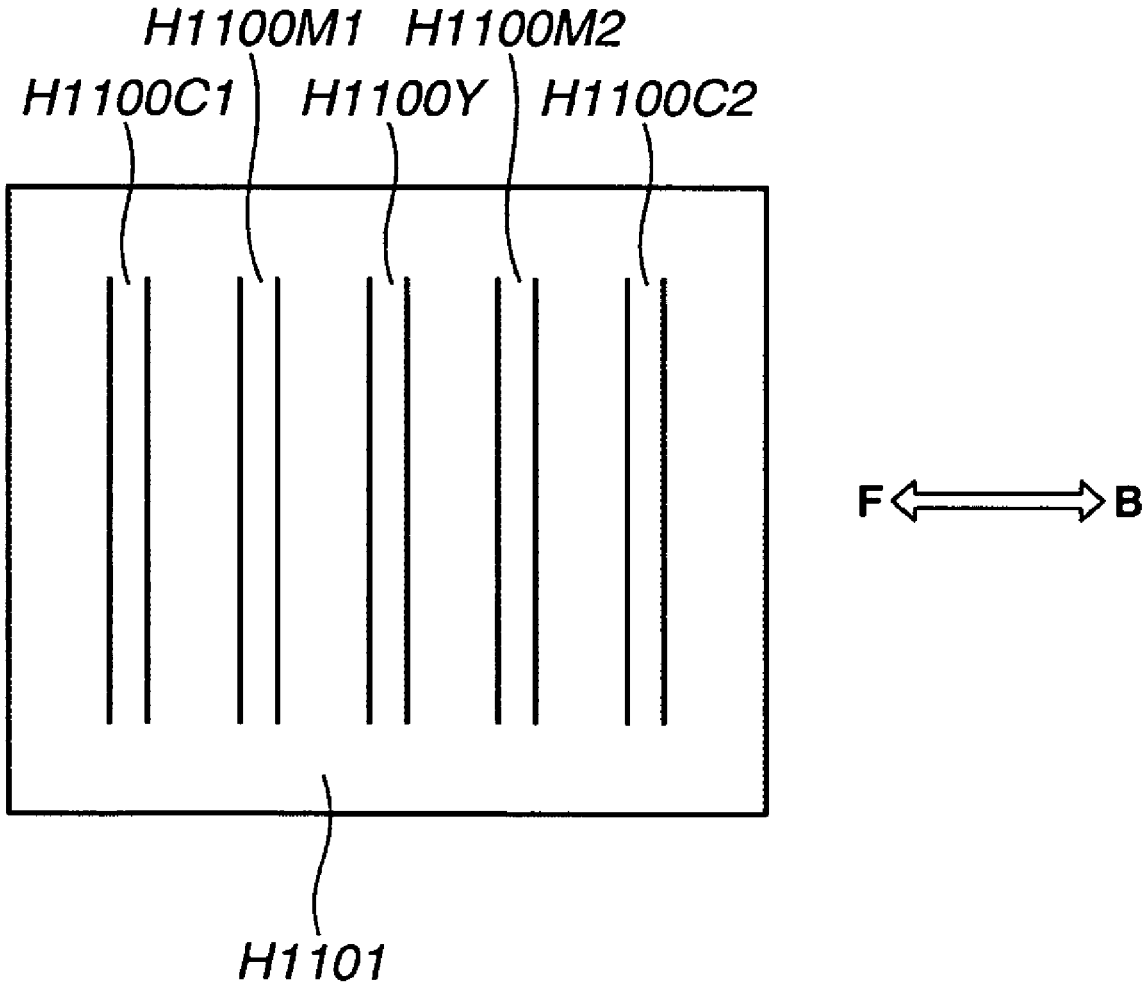
FIG. 9 is a plan view showing a recording element substrate according to the embodiment of the present invention, seen from a nozzle group.

Similar to the first recording element substrate H1100, the Si substrate H1110 is provided with the electric wiring and the electrode portions H1104. The ink fluid passage wall H1106 and the nozzle H1107 are integrally constructed on the Si substrate H1110 from a resin material according to a photolithographic technique. Similar to the first recording element substrate H1100, the electric wiring of the Si substrate H1110 receives electric power from the electrode portions H1104 on which Au bumps H1105 are formed. For the purpose of illustrating the internal structure, FIG. 6 shows a part of the Si substrate. Other structures, including the nozzle group, are also shown in part. FIG. 9 shows an actual arrangement of the nozzle group which will be described later.

The recording element substrates H1100 and H1101 are connected in such a manner that the ink supply port 1102 communicates with the ink supply port H1201 of the first plate H1200. The recording element substrates H1100 and H1101 are accurately positioned (i.e., fixed by an adhesive) to the first plate H1200. A first adhesive used in this case can have a lower viscosity and a lower curing temperature and can cure within a short period of time, and has a relatively higher hardness after being cured and has the durability against the ink. For example, the first adhesive can be a heat-curing adhesive chiefly containing an epoxy resin. The thickness of an adhesive layer is equal to or less than about 50 μm.

The second plate H1400 is, for example, a single plate member having the thickness of about 0.5 mm to 1 mm. For example, the second plate H1400 is made of alumina ($Al_2O_3$) or other ceramic or a metallic material such as Al or SUS. The second plate H1400 has two openings respectively which are wider than the contours of the first recording element substrate H1100 and the second recording element substrate H1101 bonded and fixed to the first plate H1200. The second plate 1400 is bonded to the first plate H1200 with a second adhesive. When the electric wiring tape H1300 is bonded, the electric wiring tape H1300 is electrically connected to the first recording element substrate H1100 and the second recording element substrate H1101 along a bonding surface.

The electric wiring tape H1300 forms an electric signal path for applying an electric signal (i.e., a signal for discharging or ejecting the ink) to each of the first recording element substrate H1100 and the second recording element substrate H1101. The electric wiring tape H1300 has two openings corresponding to the recording element substrates H1100 and H1101. Electrode terminals H1302 are formed along the opposed sides of respective openings, and connected to the electrode portions H1104 of the recording element substrates H1100 and H1101. The electric wiring tape H1300 has, at an end portion, an electric terminal connecting portion H1303 that is electrically connected to an electric contact substrate H2200. The electric contact substrate H2200 has an external signal input terminal H1301 for receiving an electric signal. The electrode terminals H1302 and the electric terminal connecting portion H1303 are connected via a continuous wiring pattern of copper foil.

The electric wiring tape H1300 has a reverse surface bonded and fixed to a lower surface of the second plate H1400 with a third adhesive. The electric wiring tape H1300 is bent perpendicularly and bonded to one side surface of the first plate H1200. The third adhesive is, for example, a heat-curing adhesive which chiefly contains an epoxy resin and has the thickness of about 10 μm to 100 μm.

The electric connection of the electric wiring tape H1300 and the first and second recording element substrates H1100 and H1101 is, for example, realized by electrically connecting the electrode portions H1104 of the recording element substrates to the electrode terminals H1302 of the electric wiring tape according to a thermo-ultrasonic bonding method. The electrically connected portions of the recording element substrates and the electric wiring tape are sealed with a first sealer H1307 and a second sealer H1308. This arrangement enables to protect the electrically connected portions against corrosion caused by the ink or the impact given from the outside.

The first sealer H1307 is chiefly used for sealing the reverse side of the connected portions of the electrode terminals H1302 of the electric wiring tape and the electrode portions H1104 of the recording element substrates H1100 and H1101, and also used for sealing the outer surfaces of the recording element substrates H1100 and H1101. The second sealer H1308 is used for sealing the front side of the connected portions.

The electric contact substrate H2200 is electrically connected, by thermo-compression bonding, to an end portion of the electric wiring tape H1300 using an anisotropic conducting film and the like. The electric contact substrate H2200 has terminal positioning holes H1309 and terminal connecting holes H1310. The terminal positioning holes H1309 are used for positioning the electric contact substrate H2200, and the terminal connecting holes H1310 are used for fixing the electric contact substrate H2200.

(1-2) Ink Supply Unit

As shown in FIG. 4, the ink supply member H1500 is a constituent component of the ink supply unit H1003 that leads the ink from the ink tank H1900 to the recording element unit H1002. The ink supply member H1500 is, for example, formed by resin molding. To improve structural rigidity of the resin material, the resin material can contain about 5-40% of glass filler.

Figure 7:
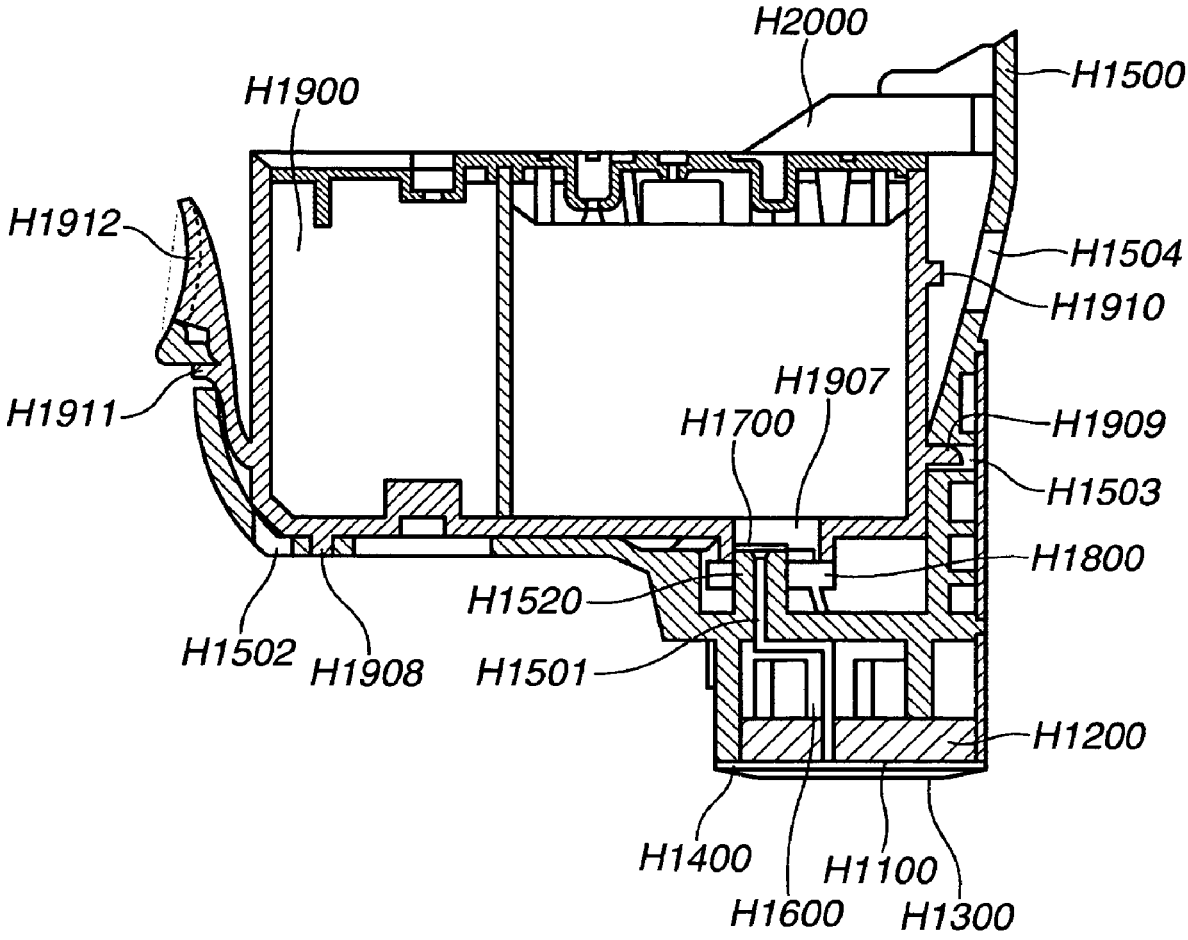
FIG. 7 is a cross-sectional side view showing the recording head cartridge shown in FIGS. 2A and 2B.

As shown in FIG. 4, the ink supply member H1500 and the tank holder H2000 cooperatively define an accommodation space for detachably accommodating the ink tank H1900. As shown in FIG. 7, a tank positioning hole H1502 is provided at a bottom portion of the accommodation space. The tank positioning hole H1502 engages with a tank positioning pin H1908 of the ink tank H1900. Two holes, i.e., first and second holes H1503 and H1504, are formed in a rear wall defining the accommodation space. The first hole H1503 engages with a first claw hook H1909 of the ink tank. The second hole H1504 engages with a second claw hook H1910. An elastically deformable lever H1912, which has a third claw hook H1911 engageable with a front wall defining the accommodation space, is provided at the front portion of the ink tank H1900. When a pushing force is applied to the lever H1012, the third claw hook H1911 is disengaged from the front wall and accordingly the ink tank H1900 is removed. The holes 1503 and 1504 are formed in the ink supply member H1500. The ink supply member H1500 is a part of the unit detachably holding the ink tank H1900.

A joint portion H1520 is provided at the bottom portion of the accommodation space for the ink tank H1900. The joint portion H1520 is brought into contact with an ink supply port H1907 of the ink tank H1900. A filter H1700, which blocks invasion of foreign particles, is bonded by welding to the top of the joint portion H1520. A rubber seal H1800, which prevents evaporation of the ink, is attached around the joint portion H1520. An ink fluid passage H1501 is formed in the ink supply member H1500. The ink fluid passage H1501 extends downward from a contact surface of the joint portion H1520 and the ink tank H1900 to a lower surface.

The fluid passage forming member H1600 is attached to the bottom surface of the ink supply member H1500. The fluid passage forming member H1600 has an ink (i.e., liquid) inlet port H1602 for supplying ink to the recording element unit H1002. The ink inlet port H1602 is positioned so as to communicate with the ink fluid passage H1501 of the ink supply member H1500.

(1-3) Connection of Recording Element Unit and Ink Supply Unit

The recording element unit H1002 and the ink supply unit H1003 are connected in the following manner.

As shown in FIG. 4, the recording element unit H1002 and the ink supply unit H1003 are fastened together with the joint seal member H2300, which is sandwiched between them, by means of screws H2400. The joint seal member H2300 can be made of an elastic material such as a rubber having a smaller compression set. Holding the recording element unit H1002 and the ink supply unit H1003 with the intervening joint seal member H2300 under a pressing force provides an adequate communication of the joint of the ink supply port H1201 so that the ink inlet port H1602 causes no leakage of ink.

The electric contact substrate H2200 of the recording element unit H1002 is positioned and fixed to the rear surface of the ink supply member H1500. The electric contact substrate H2200 is positioned by inserting two terminal positioning pins H1515 into the terminal positioning holes H1309 of the electric contact substrate H2200. The terminal positioning pins H1515 are provided on the rear surface of the ink supply unit H1003. In this case, terminal connecting pins H1516 of the ink supply unit H1003 are inserted into terminal connection holes H1310. Then, the terminal connection pins H1516 are fastened and the fixing is performed. However, the fixing method is not limited to a particular one and accordingly any other fixing unit can be used.

Figure 8:
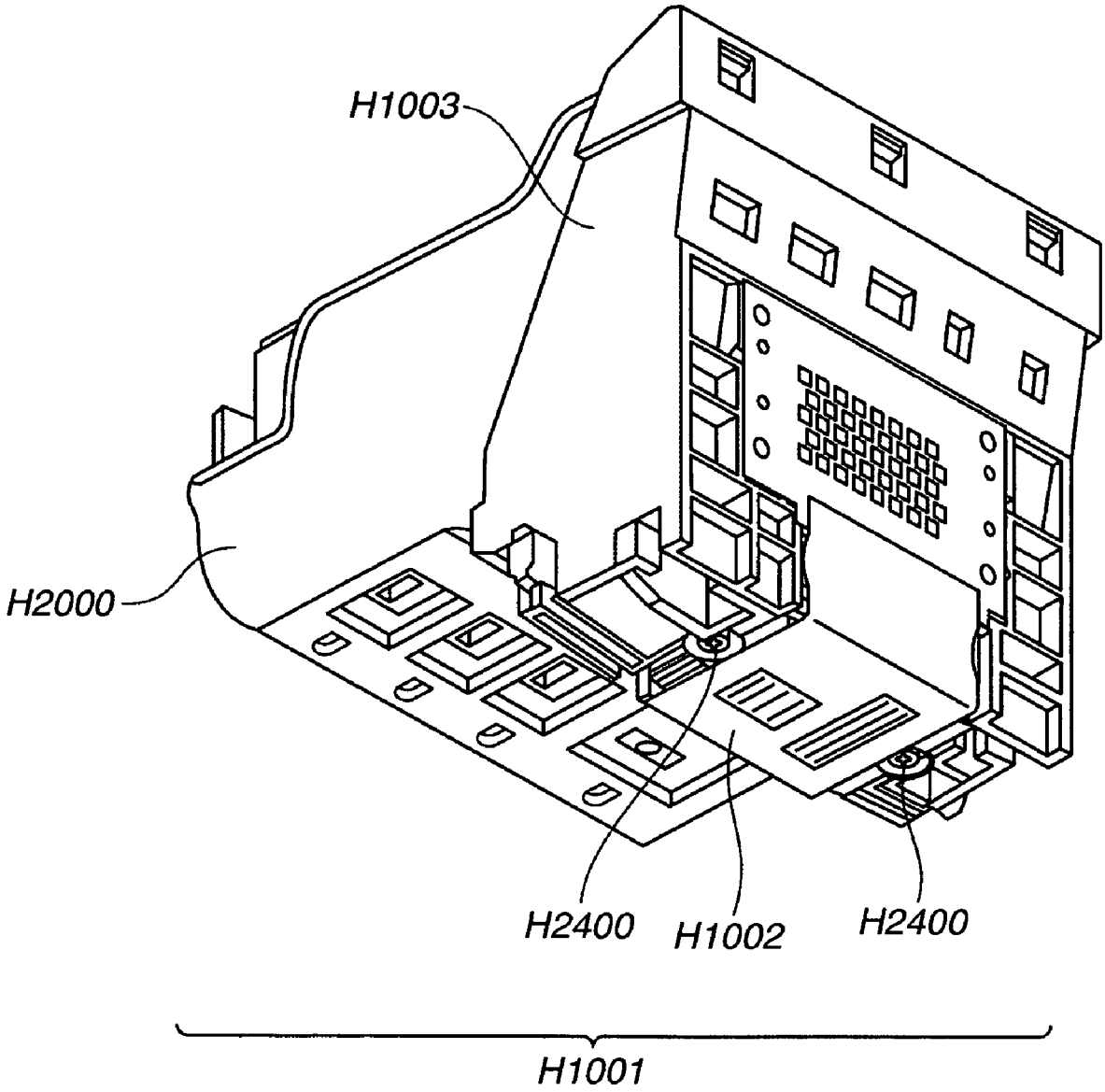
FIG. 8 is a perspective view showing a bottom side of the recording head in an assembled condition.

After the ink supply unit H1003 and the recording element unit H1002 are coupled in this manner, the assembled unit is placed into the tank holder H2000 as shown in FIG. 8. Thus, the recording head H1001 shown in FIG. 2A can be obtained.

The recording head H1001 is mounted in the carriage 2. The ink tank H1900 is attached to the recording head H1001. In such a condition, the carriage 2 moves in the main scanning direction (i.e. a carriage moving direction), and ink is discharged or ejected from the recording head H1001 to record an image on a recording medium.

<Nozzle Alignment>

The second recording element substrate H1101 in accordance with the first embodiment of the present invention has the following nozzle alignment.

FIG. 9 shows a bottom surface of the second recording element substrate H1101, on which nozzle groups of the recording head are disposed. FIG. 10 shows an enlarged bottom surface of the second recording element substrate H1101, which shows the alignment and arrangement of nozzle openings of each color nozzle group.

According to the second recording element substrate H1101 of the present embodiment, a yellow nozzle group is disposed at the center. A cyan nozzle group and a magent a nozzle group are disposed on both sides of the yellow nozzle group.

More specifically, a first cyan nozzle group H1100C1, a first magenta nozzle group H1100M1, a yellow nozzle group H1100Y, a second magenta nozzle group H1100M2, and a second cyan nozzle group H1100C2 are successively disposed in a recording scanning direction. In other words, the recording element substrate H1101 has two cyan nozzle groups and two magenta nozzle groups which are symmetrically disposed about the yellow nozzle group positioned at the center.

Such a symmetrical head arrangement enables to equalize the order of inks discharged to the recording medium in both forward and backward scanning operations. Therefore, when bidirectional recording is performed for speedy printing, no unevenness in colors occurs in the forward scan and the backward scan because there is no difference in the ink discharge or ejection order.

Each nozzle group consists of two nozzle arrays. The first cyan nozzle group H1100C1 includes an even nozzle array L0 composed of nozzles (even nozzles) EC1 forming an even raster and an odd nozzle array L1 composed of nozzles (odd nozzles) OC1 forming an odd raster. The first magenta nozzle group H1100M1 includes an even nozzle array L2 composed of even nozzles EM1 and an odd nozzle array L3 composed of odd nozzles OM1. The yellow nozzle group H1100Y includes an even nozzle array L4 composed of even nozzles EY and an odd nozzle array L5 composed of odd nozzles OY. The second magenta nozzle group H1100M2 includes an even nozzle array L6 composed of even nozzles EM2 and an odd nozzle array L7 composed of odd nozzles OM2. The second cyan group H1100C2 includes an even nozzle array L8 composed of even nozzles EC2 and an odd nozzle array L9 composed of odd nozzles OC2.

The even nozzle arrays L0 and L2 of the first cyan nozzle group H1100C1 and the first magenta nozzle group H1100M1 are composed of large-diameter nozzles that can discharge or eject a large ink droplet having the size of about 5.0 pl. The odd nozzle arrays L1 and L3 are composed of small-diameter nozzles that can discharge or eject a small ink droplet having the size of about 1.5 pl.

The even nozzle arrays L6 and L8 of the second magenta nozzle group H1100M2 and the second cyan nozzle group H1100C2 are composed of small-diameter nozzles that can discharge or eject a small ink droplet having the size of about 1.5 pl. The odd nozzle arrays L7 and L9 are composed of large-diameter nozzles that can discharge or eject a large ink droplet having the size of about 5.0 pl.

Each nozzle array includes a total of 256 nozzles for realizing the alignment density of 600 dpi. The nozzles constituting one nozzle array (for example, even nozzle array) and the nozzles constituting the other nozzle array (for example, odd nozzle array) are alternately disposed. In other words, each nozzle group includes two nozzle arrays of the same color and the same discharge amount that are offset, by the density of 600 dpi, and disposed in a staggered fashion. Thus, the resolution of 1200 dpi can be realized.

As shown in FIG. 10, regarding the cyan and magenta colors, an ink droplet (i.e., large droplet) discharged from the large-diameter nozzle and an ink droplet (i.e., small droplet) discharged from the small-diameter nozzle can be impacted to the same raster. A dot formed with a small droplet on a recording medium is a relatively small-diameter dot (i.e., so-called small dot). A dot formed by a large droplet on a recording medium is a relatively large-diameter dot (i.e., so-called large dot).

According to the recording apparatus of the present embodiment, each discharge (or ejection) heater of the recording head is driven with a drive voltage of 24V and a drive frequency of 30 KHz. The carriage moves at the rate of 25 inch/sec so that the resolution of 1200 dpi can be obtained in the scanning direction of the carriage.

<Control System>

Figure 11:
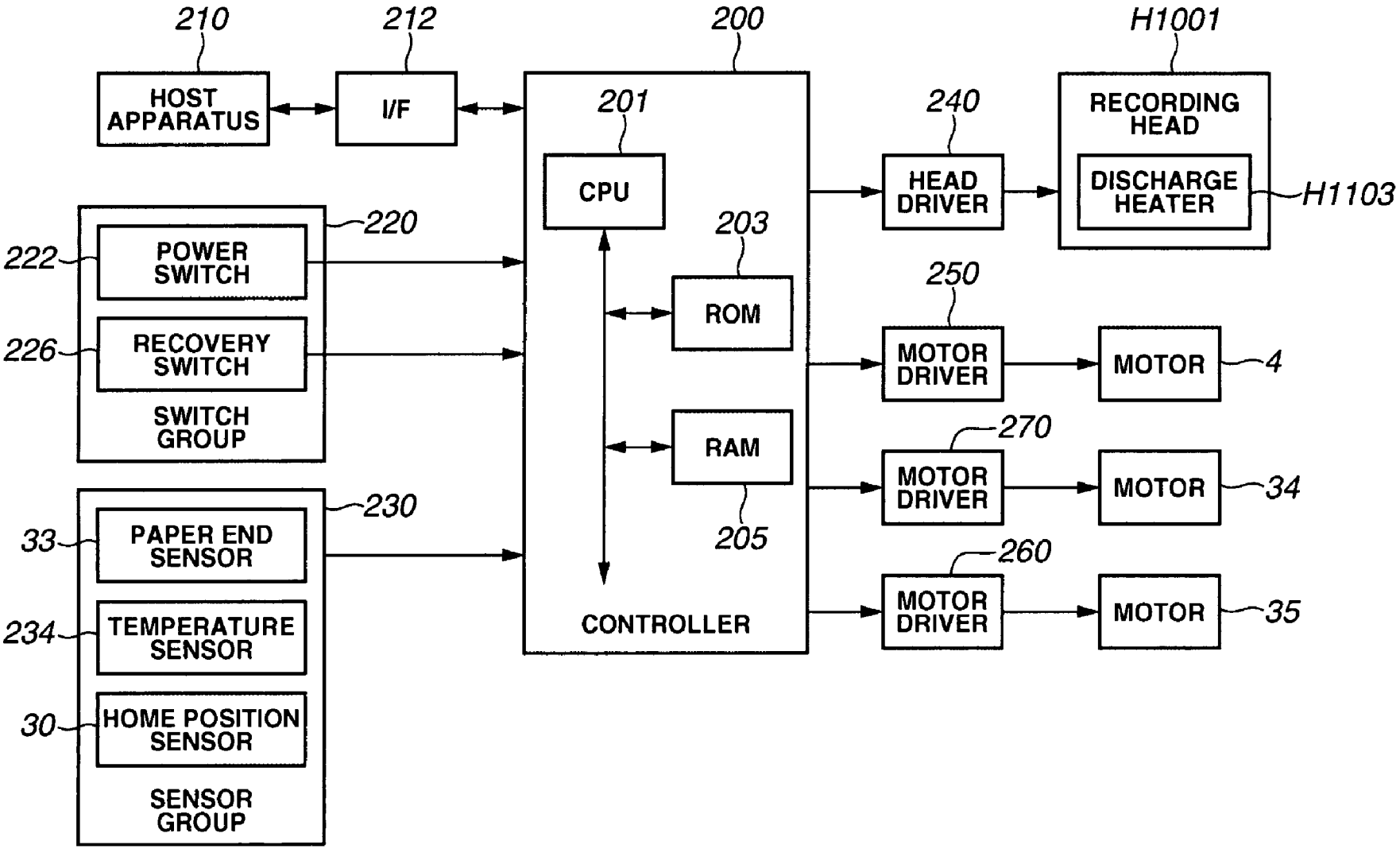
FIG. 11 is a block diagram showing an arrangement of a control system for the inkjet recording apparatus according to the embodiment of the present invention.

FIG. 11 is a block diagram showing a schematic arrangement of a control system of the inkjet recording apparatus. In FIG. 11, a controller 200 is a main control portion that includes, for example, a CPU 201 configured as a microcomputer, a ROM 203 storing programs or required tables and other data, and a RAM 205 having image data regions and work regions. A host apparatus 210, as a source for supplying image data, is constituted by a computer which produces and processes image data to be recorded and/or a reader for reading the images. The host apparatus 210 and the controller 200 exchange the image data, other commands, and status signals via an interface (I/F) 212.

A switch group 220 is connected to the controller 200. The switch group 220 includes a plurality of switches for inputting various data and commands, including a power switch 222 and a recovery switch 226 instructing a suction recovery action.

A sensor group 230, which detects operating conditions of the inkjet recording apparatus, is connected to the controller 200. The sensor group 230 includes the above-described home position sensor 30, the paper end sensor 33 detecting the presence of a recording medium, and a temperature sensor 234 provided at an appropriate portion to detect an ambient temperature.

A head driver 240, which drives the recording head H1001, is connected to the controller 200. The recording head H1001 of the present embodiment has electrothermal conversion elements (i.e., discharge heaters) H1103 provided in a plurality of nozzles for discharging the ink droplets. Each discharge heater H1103 generates thermal energy for discharging an ink droplet from the nozzle and is driven by the driver 240.

Motor drivers 250, 260, and 270 respectively driving the motors 4, 35, and 34 in the inkjet recording apparatus are connected to the controller 200. The motor driver 250 drives the main scanning motor 4. The motor driver 270 drives a sub scanning motor 34 that conveys the recording medium 8 in a sub scanning direction. The motor driver 260 drives the paper feeding motor 35 that is mounted on the paper feeding tray of the ASF 32 to pick up and feed a recording medium 8 from the ASF 32.

Figure 12:
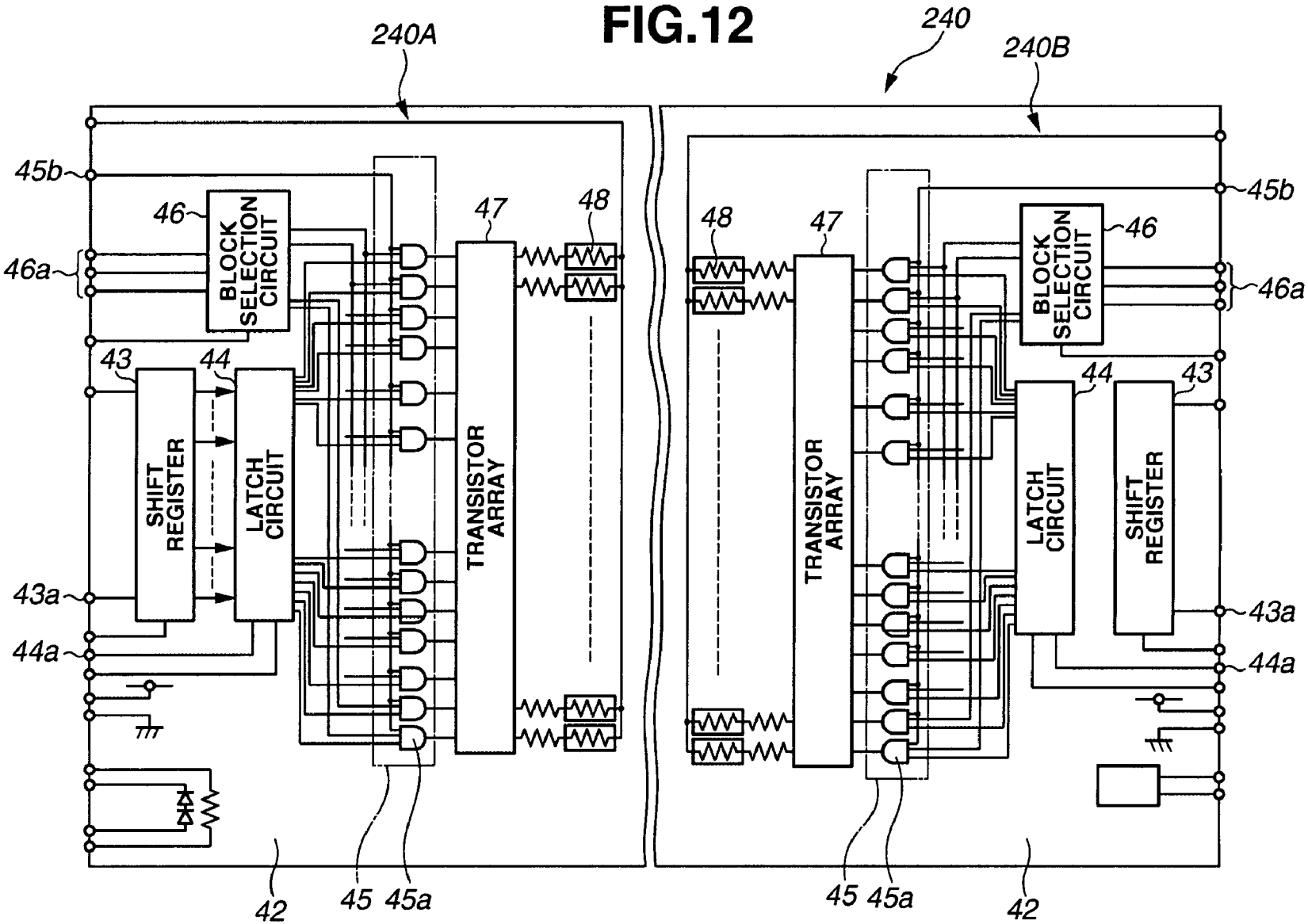
FIG. 12 is a block diagram showing a schematic arrangement of a head driver shown in FIG. 11.

FIG. 12 is a block diagram showing a schematic arrangement of head drivers provided in the recording head to drive respective nozzle groups.

A total of ten head drivers are provided for the nozzle arrays of the above-described nozzle groups H1100C1, H1100M1, H1100Y, H1100M2, and H1100C2.

FIG. 12 shows only two head drivers 240A and 240B. One head driver 240A is a head driver for the even nozzle array L0 (or L2) of the first cyan nozzle group (or first magenta nozzle group). The other head driver 240B is a head driver for the even nozzle array L8 (or L6) of the second cyan nozzle group (or second magenta nozzle group). The head drivers 240A and 240B are structurally identical with each other. Accordingly, same portions of the head drivers 240A and 240B are denoted by the same reference numerals. Similar head drivers are provided for other nozzle arrays.

The head drivers 240A and 240B operate in the following manner.

In FIG. 12, a recording head base 42 includes a head driver 240 and a recording head H1101 that are integrally arranged. A shift register 43 holds a recording signal serially entered from an input terminal 43*a* in synchronism with a shift clock. A latch circuit 44 latches parallel recording data produced from the shift register 43 in response to a latch signal entered from an input terminal 44*a*. An AND gate array 45 includes a predetermined number of AND gates 45*a* corresponding to the nozzle number. Each AND gate 45*a* produces an AND output of a recording data produced from the latch circuit 44, a signal produced from a block selection circuit 46, and a heat pulse signal entered from an input terminal 45*b*. A transistor array 47 includes a plurality of transistors each controlling supply or stop of current supplied to a heater 48 of each nozzle in accordance with a drive control signal supplied from the AND gate array 45. The block selection circuit 46 produces an output signal for driving respective blocks (or groups) of the heaters in the recording head in a time-division fashion.

Figure 13:
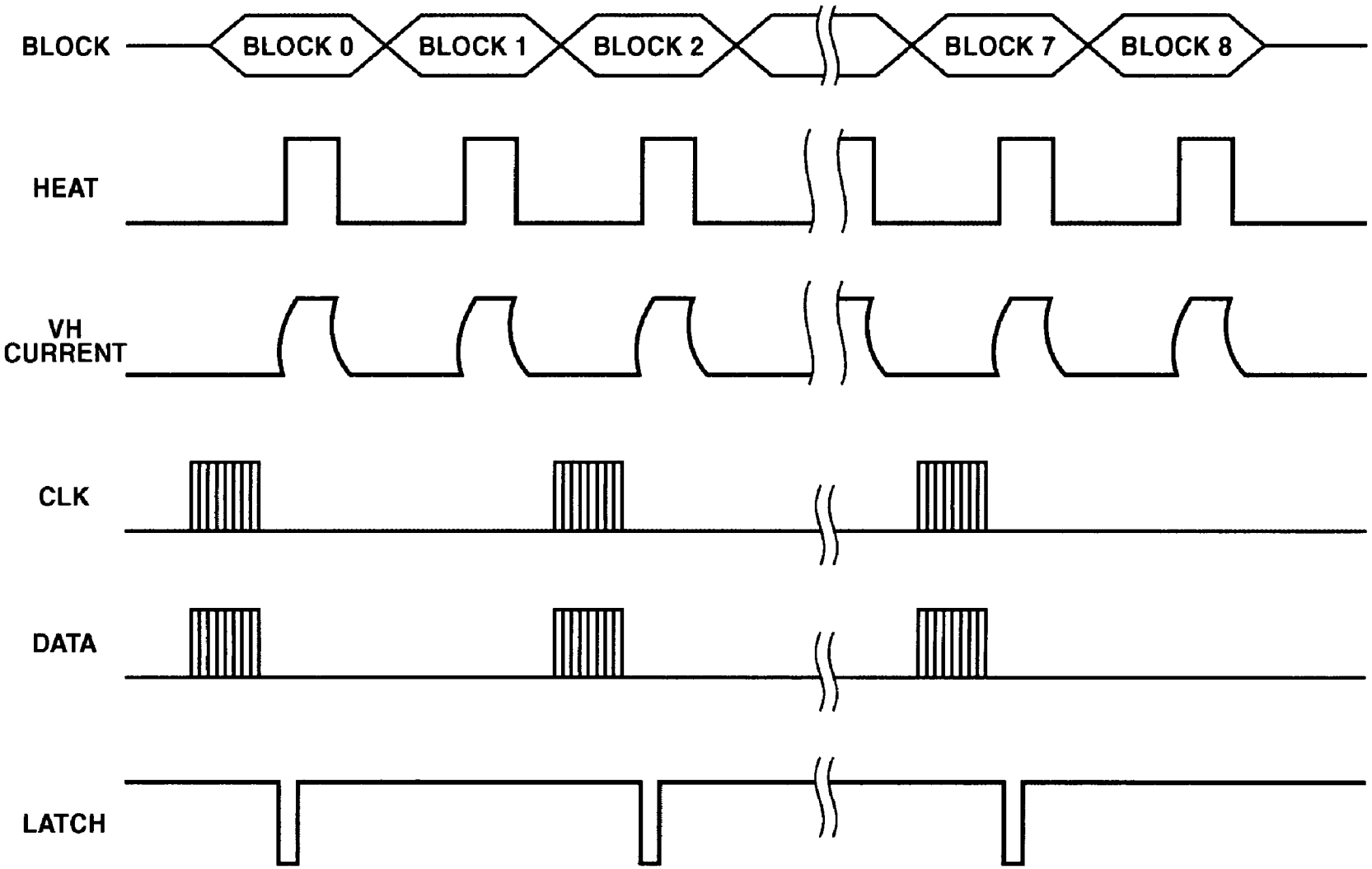
FIG. 13 is a timing chart showing a heater drive operation of the recording head according to the embodiment of the present invention.

FIG. 13 is a timing chart showing operations of the head driver. The shift register 43 successively transfers, in response to a transfer clock (CLK), the recording data (DATA) that are serially supplied from the input terminal. At the time the recording data corresponding to respective nozzle arrays of the recording head are transferred, the shift register 43 outputs the recording data, as parallel data, to the latch circuit 44.

The latch circuit 44 holds the recording data supplied from the shift register 43 for a predetermined period of time in response to a latch signal (Latch). A signal corresponding to each nozzle array is supplied to each AND gate 45*a* of a logic circuit which is provided so as to correspond to each heater 48. The block selection circuit 46 inputs, at predetermined timings, a 3-bit block designation signal 46*a* supplied from the controller 200.

A block enable signal (blocks 0 to 8) is entered to the AND gate 45*a* corresponding to the nozzle block designated by the block designation signal 46*a*. Each AND gate 45*a* outputs, to a corresponding transistor of the transistor array 47, a signal representing an AND result of the block enable signal, the recording data produced from the latch circuit 44, and the heat pulse signal. When the block enable signal, the discharge data indicating an ink discharge (i.e., one of the recording data), and the heat pulse data are entered into the AND gate 45*a*, the AND gate 45*a* produces a high-level output signal to turn on a corresponding transistor. When the transistor is turned on, current flows across a heater connected to the transistor. The heater generates heat, and the ink in the nozzle causes film boiling. Thus, an ink droplet is discharged from a discharge port. The block enable signal is successively switched from Block 0 to Block 8 at predetermined intervals. The heaters of respective blocks are successively driven, so that ink droplets are discharged from the nozzles to form an image of inks on a recording medium.

The above-described operation is carried out in each of the head drivers 240A and 240B.

Figure 17:
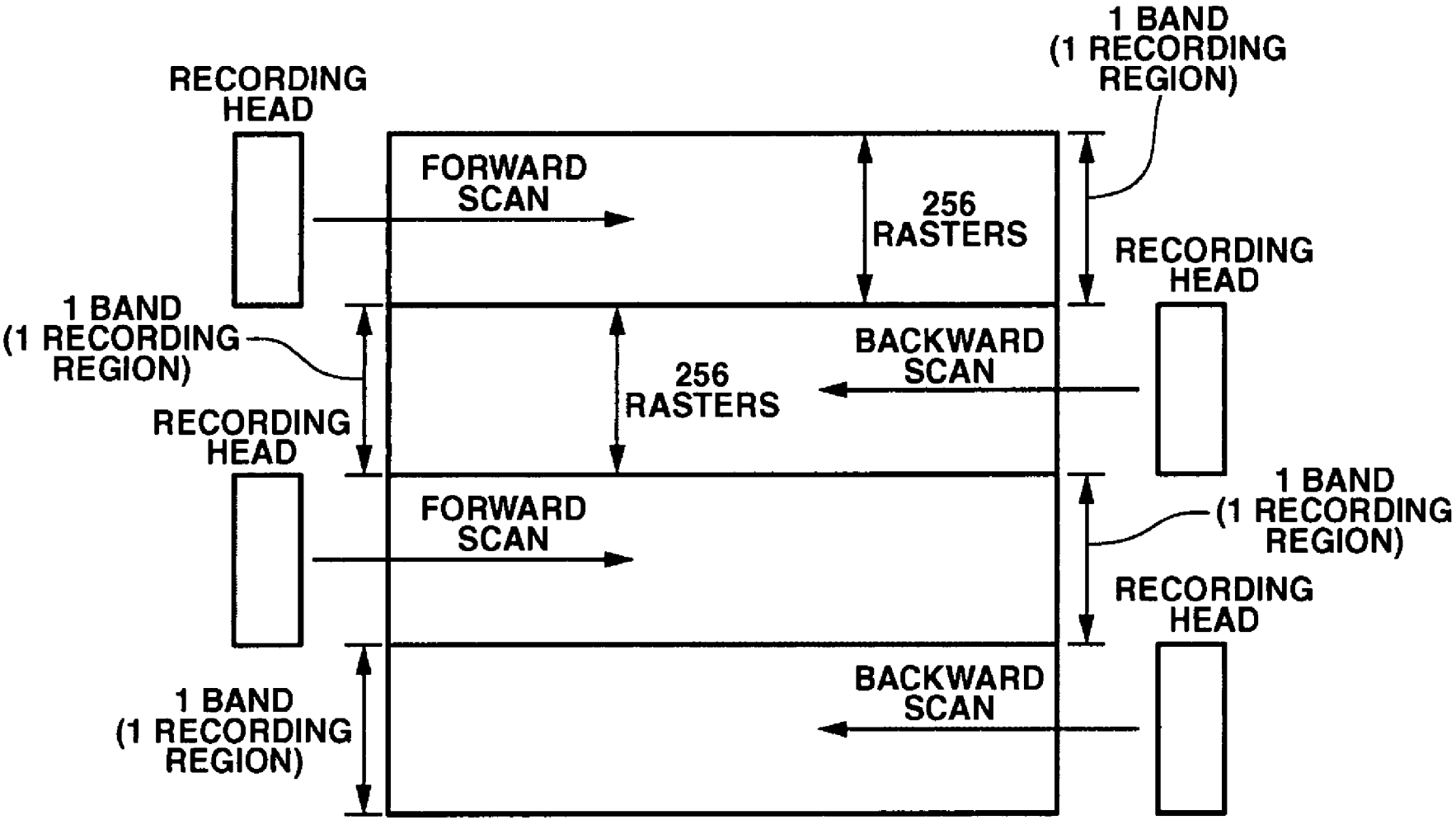
FIG. 17 is a schematic view showing a single-pass bidirectional recording operation performed according to the first embodiment of the present invention.

The controller 200 performs data processing for the recording data supplied to end nozzles of each nozzle array, prior to the input to the head drivers 240A and 240B. As shown in FIG. 17, the present embodiment is based on a single-pass bidirectional recording method according to which a forward scan recording operation and a backward scan recording operation are alternately performed to record respective bands. In FIG. 17, the band which is recordable during one scanning operation of the recording head has a width of 256 nozzles. One band is constituted by a total of 256 rasters.

The recording data entered into the head driver 240B of the even nozzle array L8 of the second cyan nozzle group H1100C2 which discharges small ink droplets are processed in the following manner.

A recording data transmitted from the host apparatus 210 is stored in a print buffer of RAM 205 via an I/F 212. The print buffer is provided for each nozzle array of the recording head. Each print buffer stores recording data corresponding to each nozzle array which is recorded during one recording scan. The CPU 201 accesses the binary recording data stored in the print buffer and counts the number of 1-valued data that instructs the discharge of ink (hereinafter, referred to as "discharge data"). Then, the CPU 201 determines whether or not the discharge data number corresponding to the next recording region (i.e., band) exceeds a predetermined threshold. Namely, CPU 201 calculates a recording dot number for each band with respect to respective color nozzle arrays, and determines whether or not the calculated recording dot number exceeds the threshold.

Then, in response to a recording operation start command, CPU 201 reads the recording data, as serial data; from the print buffer and successively transfers the readout data to the shift register 43. When the recording dot number exceeds the threshold, the recording data corresponding to an endmost nozzle of the cyan nozzle array and the magenta nozzle array (i.e., endmost nozzle data) are subjected to the processing different from the processing applied to the rest of the readout serial data. More specifically, when the recording dot number exceeds the threshold, the small dots to be recorded by the end nozzles are replaced with large dots. In the description, "the endmost nozzle of the nozzle array" is a nozzle positioned at the outermost side of the nozzle array. A later-described "end nozzle of the nozzle array" represents at least one nozzle selected from a group consisting of the endmost and neighboring nozzles of the nozzle array.

Figure 18:
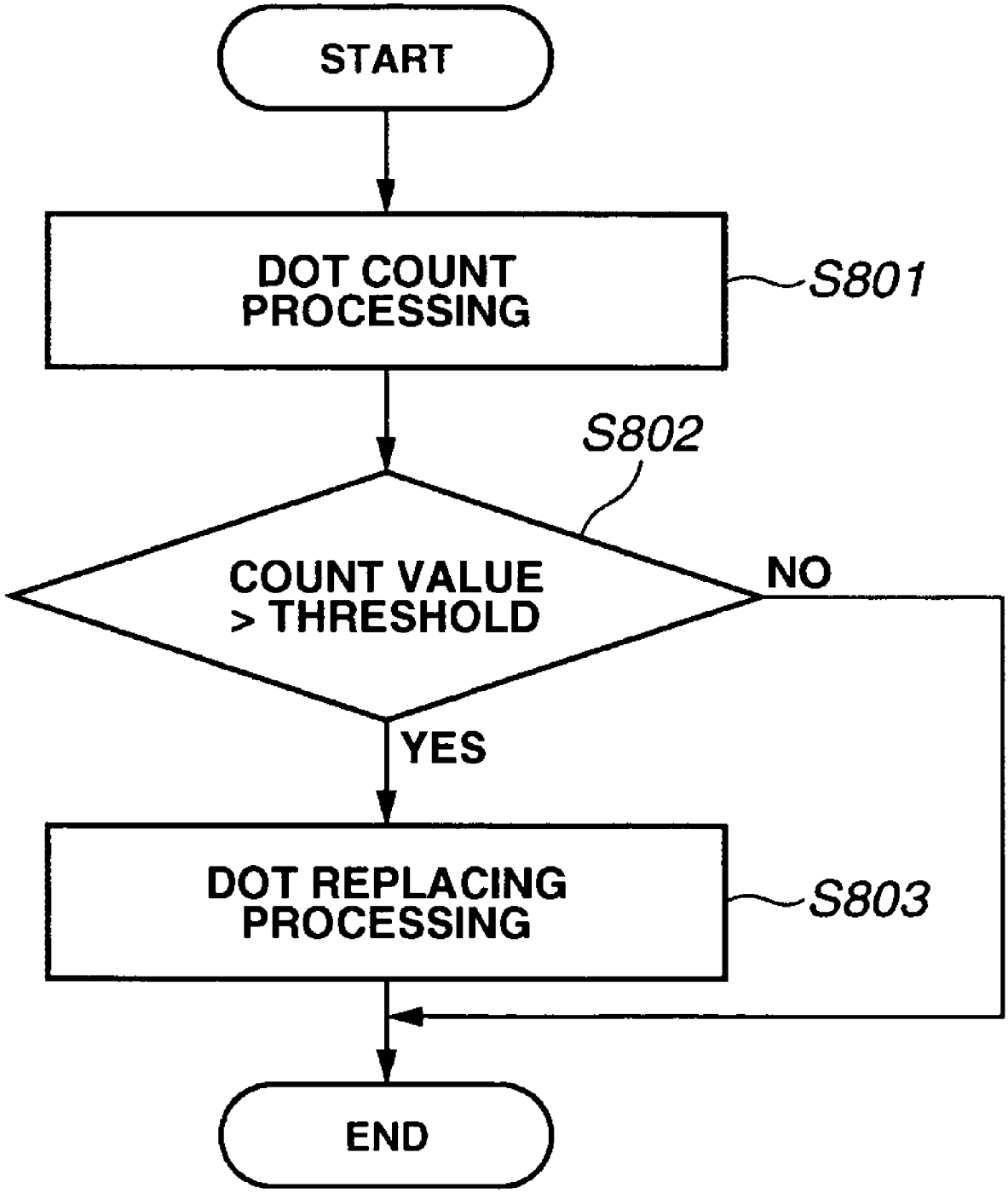
FIG. 18 is a flowchart showing dot replacing process according to the embodiment of the present invention.

According to the first embodiment, the following processing is performed in the recording operation of the nozzle array L0 (or L2) that forms large dots as the second nozzle array as well as in the recording operation of the nozzle array L8 (or L6) that forms small dots as the first nozzle array. FIG. 18 shows the contents of the processing executed by the CPU 201 in accordance with the program stored in the ROM 203.

First, in step S801, the CPU 201 counts the number of recording dots in the recording region (i.e., band) to be recorded during one scanning operation. Then, in S802, the CPU 201 determines whether or not the count value exceeds a predetermined threshold. When the count value exceeds the threshold, the control flow proceeds to step S803 in which the CPU 201 executes the processing for replacing the small dots being initially designated for the edge raster with large dots (i.e., dot replacing processing).

One example of the dot replacing processing is as follows. First, among the recording data stored in the print buffer, all of the endmost nozzle data corresponding to the endmost nozzle EC2 (EM2) of the nozzle array L8 (or L6) that forms small dots are converted into 0-valued data representing no discharge of ink. For example, when the endmost nozzle data is detected as having a value "1" indicating the discharge of ink, the detected 1-valued data is converted into a 0-valued data. Then, the converted 0-valued data is transferred to the shift register 43. In other words, when the recording dot number exceeds the threshold, no ink droplet is discharged from the end nozzle of the nozzle array EC2 that forms small dots. The threshold is set to such a value that the air stream generated around the recording head may cause a large deviation in the impact position of the small droplet.

Next, among the endmost nozzle data corresponding to the endmost nozzle EC1 (or EM1) of the nozzle array L0 (or L2) that forms large dots, an endmost nozzle data corresponding to a designated small dot forming position is converted into a 1-valued data representing the discharge of ink. Namely, regarding the position (i.e., designated small dot forming position) where the 1-valued data indicating the discharge of a small ink droplet is converted into a 0-valued data, the large ink droplet data is forcibly converted into a 1-valued data even if it is a 0-valued data. The converted data is transferred to the shift register 43. Accordingly, when the recording dot number exceeds the threshold, a large ink droplet is discharged from the endmost nozzle EC1 (or EM1) of the nozzle array L0 (or L2) to the designated small dot forming position and as a result a large dot is formed there.

As described above, the first embodiment prevents a small ink droplet from being discharged from the endmost nozzle EC2 (or EM2) when the recording dot number of one recording region (i.e. one band) exceeds the threshold. Instead, a large ink droplet is discharged from the end nozzle EC1 (or EM1). Therefore, instead of a small dot, a large dot is discharged to the end portion of the image in a recording region (i.e., a band) to be recorded during one scanning operation. FIG. 14B shows the condition of dots having been thus formed.

Figure 14A:
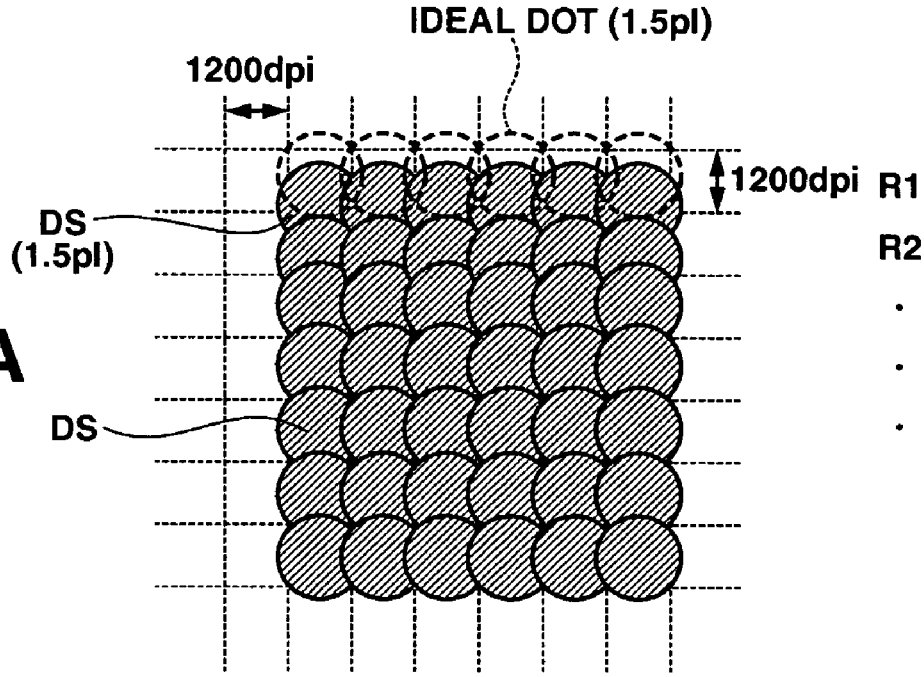
FIGS. 14A and 14B are schematic views showing dots formed on a recording medium in accordance with a first embodiment of the present invention.
Figure 14B:
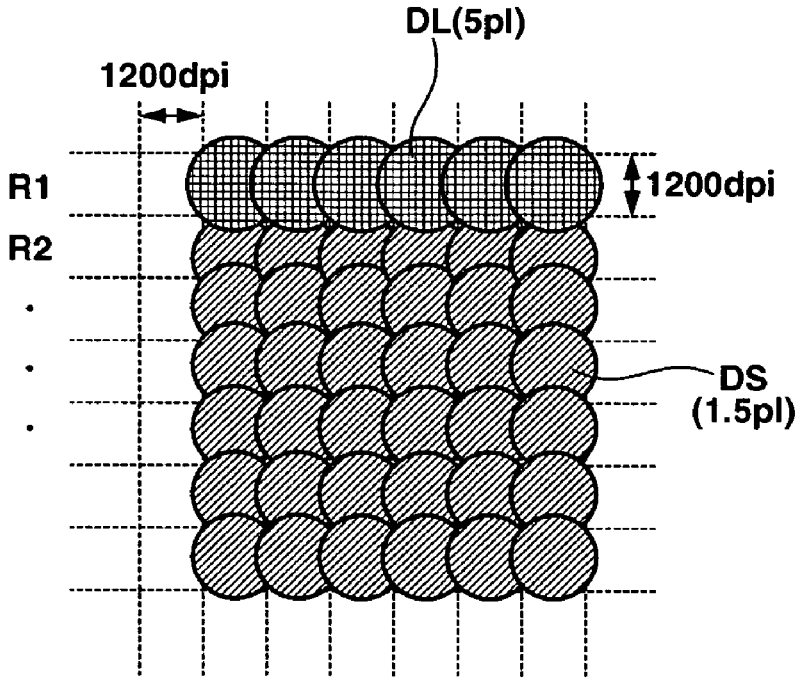

FIGS. 14A and 14B show the dot impact condition in the vicinity of the end portion of a band. FIG. 14A shows an endmost raster R1 consisting of small dots, in which no dot replacing processing is performed. The rasters R1, R3, R5, - - - consist of small dots DS formed with small ink droplets (ink amount: 1.5 pl) which are discharged from the nozzles EC2 of the even nozzle array L8 of the second cyan nozzle group H1100C2. On the other hand, the rasters R2, R4, R6, - - - consist of small dots DS formed with small ink droplets (ink amount: 1.5 pl) which are discharged from the nozzles OC1 of the odd nozzle array L1 of the first cyan nozzle group H1100C1.

When the recording duty is high, respective dots DS constituting the raster R1 are formed at a position deviated by approximately 10 μm toward the center of the nozzle array, as shown in FIG. 14A. A main factor causing such a deviation is an air stream around the recording head. Because of the presence of such an air stream, the ink droplet discharged from the end nozzle of the recording head is offset or deviated toward the center of the nozzle array. A broken line of FIG. 14A shows an ideal dot DS whose center coincides with the center of a grid.

Hence, instead of using an initially designated small dot DS, the present embodiment uses a large dot DL as a dot that forms the raster R1 corresponding to the end portion of the recording region, as shown in FIG. 14B. FIG. 14B shows the condition that the small dots DS to be impacted to the raster R1 by the nozzles EC2 of the nozzle array L8 are replaced with the large dots DL formed with large ink droplets discharged from the end nozzles EC1 of the nozzle array L0. Using a large dot DL for forming the end portion of the recording region as shown in FIG. 14B is advantageous in that the effect of an air stream can be minimized, and accordingly the impact deviation of an end dot can be reduced. Furthermore, forming the end portion of each recording region with large dots is effective in eliminating a white streak appearing between recording regions. The effect of eliminating a white streak can be also obtained in each of the cyan ink and the magenta ink.

Modified Embodiment of First Embodiment

According to the above-described embodiment, the recording dot number is calculated for each band with respect to respective color nozzle arrays. It is determined whether or not the calculated dot number exceeds a threshold. When the dot number exceeds the threshold, a small dot to be recorded by an end nozzle of the nozzle array is replaced with a large dot of the same color of other nozzle array. However, any other reference can be used to determine whether to execute the dot replacing processing. For example, a total number of each color dot recorded in a band can be calculated, then determining whether or not the total number exceeds a threshold, and then replacing a small dot to be recorded by an end nozzle with a large dot of the same color when the total number exceeds the threshold. The threshold used in the modified embodiment is larger than the threshold used in the first embodiment.

Second Embodiment

The second embodiment can eliminate both white and black streaks appearing between scanning regions. The recording apparatus used in the second embodiment is identical in the structural and control arrangements with the recording apparatus used in the first embodiment. Like the first embodiment, a recording operation of the second embodiment is performed with a drive voltage of 24V, a drive frequency of 30 KHz, and a carriage speed of 25 inch/sec, so that the resolution of 1200 dpi can be obtained in the main scanning direction. The recording head used in the second embodiment is identical with the recording head used in the first embodiment shown in FIG. 10.

Figure 15:
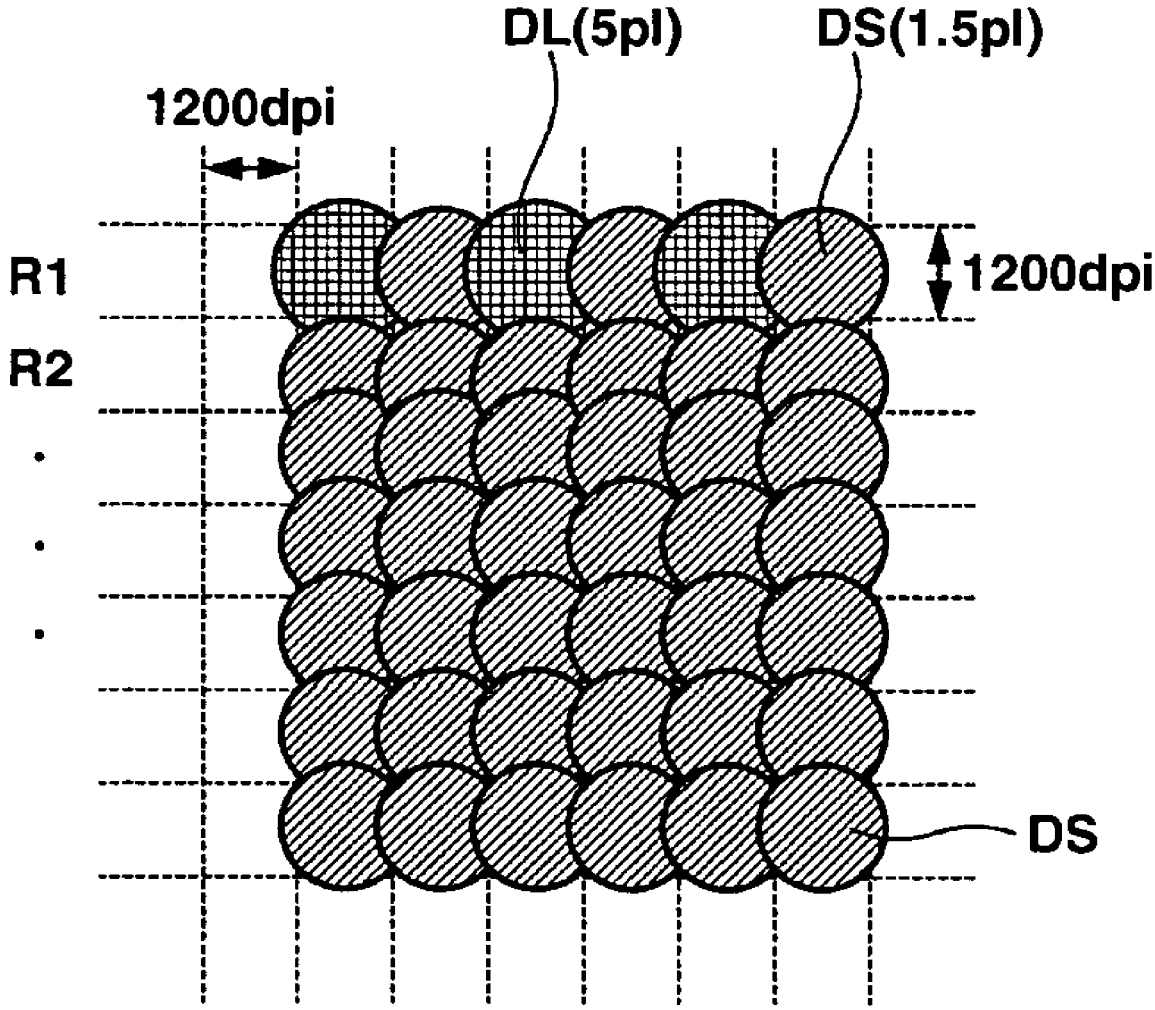
FIG. 15 is a schematic view showing dots formed on a recording medium in accordance with a second embodiment of the present invention.

FIG. 15 shows an example of the impact condition of ink droplets according to the second embodiment. According to the second embodiment, with respect to the raster R1 positioned at an end portion (band) of a recording region, the small dots DS are partly replaced with large dots DL. Accordingly, the second embodiment does not replace all of the to-be-recorded small dots DS with large dots DL. The raster R1 is a combination of small dots DS and large dots DL.

The ratio of the small dots DS and the large dots DL constituting the raster R1 should be determined in consideration of an effect in reducing white and black streaks. According to the example shown in FIG. 15, approximately half of the raster R1 (i.e. designated small dot forming position) is formed with small dots DS and the rest is formed with large dots DL. For example, when input recording data indicates that the entire raster R1 should be formed with small dots DS, the end nozzle EC2 of the even nozzle array L8 is driven only for every other dot and the end nozzle EC1 of the even nozzle array L0 is driven to form large dots DL for the remaining small dot forming position. In other words, to form the raster R1, the processing for replacing a small dot DS with a large dot DL is performed every other dot.

Thus, according to the second embodiment, the edge raster R1 of each recording region includes large dots DL that are less affected by an air stream. Providing large dots DL between recording regions is effective in reducing a white streak appearing between the recording regions. Furthermore, compared with the first embodiment that forms the entire raster R1 with large dots DL, the concentration of the entire raster R1 can be suppressed adequately and a black streak generated by the large dots DL can be reduced appropriately.

Third Embodiment

According to the first and second embodiments, at least part of the small dots for the endmost raster of a band is replaced with large dots. However, the target raster to which the dot replacing processing is applied is not limited to the endmost raster. The third embodiment is characterized in that the dot replacing processing is applied not only to an endmost raster but also to neighboring rasters, so that at least part of the small dots of each raster is replaced with large dots. The recording apparatus used in the third embodiment is identical in the structural and control arrangements with the recording apparatus used in the first embodiment.

Figure 16:
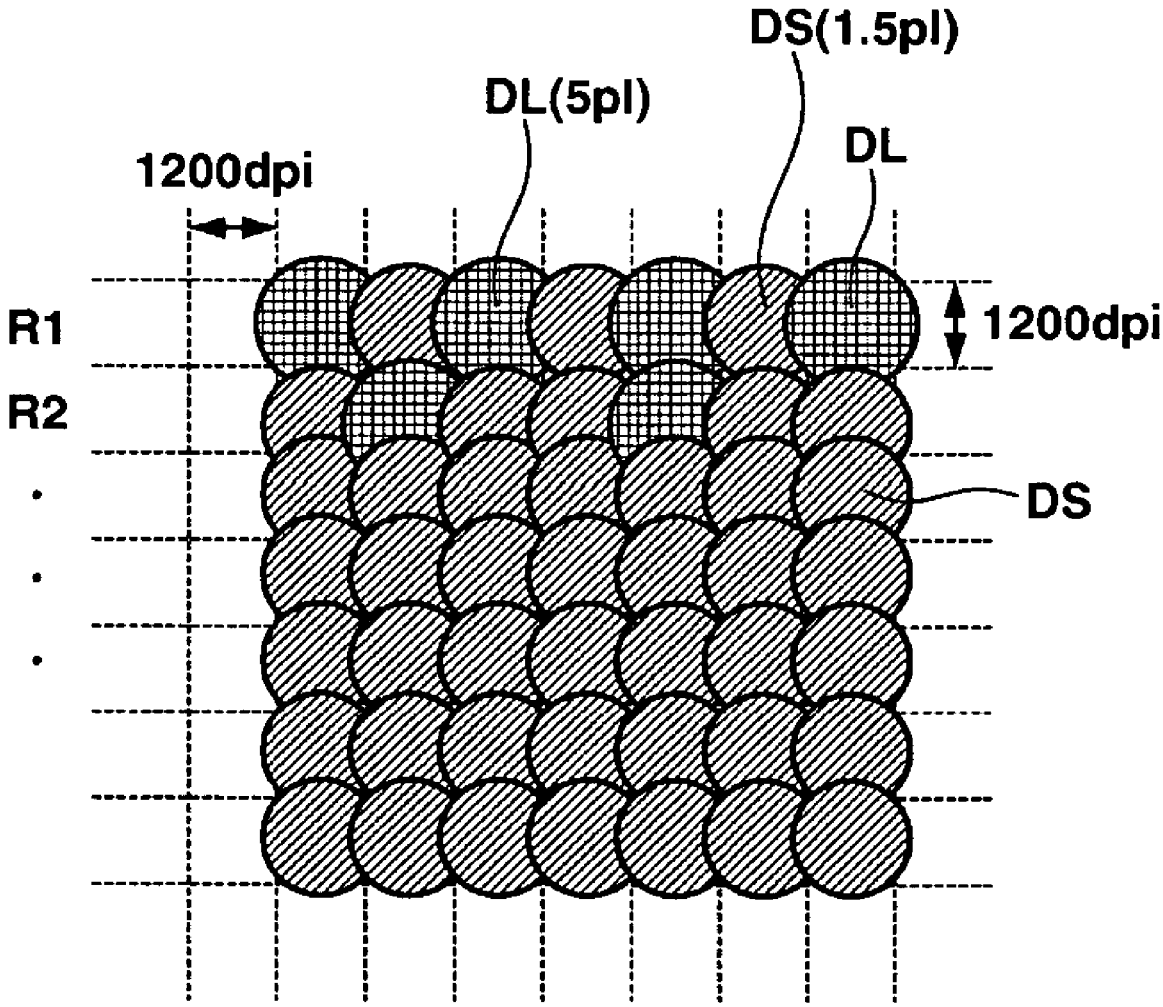
FIG. 16 is a schematic view showing dots formed on a recording medium in accordance with a third embodiment of the present invention.

FIG. 16 shows the impact condition of ink droplets according to the third embodiment. In an example shown in FIG. 16, small dots DS of an endmost raster R1 and a neighboring raster R2 are partly replaced with large dots. More specifically, like the raster R1 shown in FIG. 15, large dots DL and small dots DS are alternately disposed to form the raster R1. Regarding the raster R2, the replacing a small dot DS with a large dot DL is performed every two other dots. Although FIG. 16 shows the dot replacing processing applied to an endmost raster and a neighboring raster, the number of rasters to which the dot replacing processing is applied is not limited to these number. Therefore, the dot replacing processing can be adequately applied to an endmost raster and a desired number of neighboring rasters.

According to the third embodiment, like the above-described first embodiment, a white streak appearing between recording scanning regions can be reduced. Furthermore, like the above-described second embodiment, white and black streaks appearing between recording scanning regions can be adequately reduced. Moreover, applying the dot replacing processing to not only an endmost raster R1 but also a neighboring raster R2 is effective in reducing the adverse effect of impact deviation caused by small dots in a wide region.

As described above, the dot replacing process of the present invention is applied to a raster positioned at the end portion of a band. In this case, the raster positioned at the end portion is an endmost raster (refer to the first or second embodiment) or a combination of an endmost raster and neighboring rasters (refer to the third embodiment).

Other Embodiment

In the above-described embodiments, each nozzle group formed in the recording head consists of two nozzle arrays. Regarding the cyan and magenta nozzle groups, the nozzle group is a combination of a nozzle array for forming large dots and a nozzle array for forming small dots. However, the present invention is also applied to a recording head having nozzle groups each arranged by a single nozzle array. Also in this case, there can be provided both a nozzle array for forming large dots and a nozzle array for forming small dots, as the nozzle arrays for discharging cyan and magenta inks, so as to form large and small dots on the same raster.

Moreover, application of the present invention is not limited to a single-pass recording system that is characterized by accomplishing the recording of an image in a region corresponding to a width of the recording head (e.g., the region of 256 rasters shown in FIG. 17) during only one recording scanning operation. The present invention can be applied to a multi-path recording system that requires a plurality of recording scanning operations for accomplishing the recording of an image in a region corresponding to a width of the recording head.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-363598 filed Dec. 15, 2004, which is hereby incorporated by reference herein in its entirety.

What is claimed is:

1. An inkjet recording apparatus for effecting recording on a recording medium by a recording unit during a relative movement between the recording unit and the recording medium, the recording unit configured to discharge small ink droplets and large ink droplets larger than the small ink droplets, the large ink droplets and the small ink droplets being the same color, comprising:

a counting unit configured to count a number of discharge data for discharging the small ink droplets to be used for forming a band to be recorded by the recording unit during one relative movement;

a determining unit configured to determine whether or not to perform a process for replacing discharge data for discharging at least one of the small ink droplets used for forming at least one raster positioned at an end portion of the band with discharge data for discharging at least one large ink droplet, based on a count value obtained by the counting unit; and a process unit configured to perform the process based on a determination result by the determining unit.

2. The inkjet recording apparatus according to claim 1, wherein if the count value exceed a predetermined threshold, the determining unit determines that the process is performed, and if the count value does not exceed the predetermined threshold, the determining unit determines that the process is not performed.

3. The inkjet recording apparatus according to claim 2, wherein the at least one raster positioned at the end portion is a raster positioned at an endmost portion of the region.

4. The inkjet recording apparatus according to claim 2, wherein the raster positioned at the end portion is a raster positioned at an endmost portion of the band and a raster positioned in the vicinity of the raster positioned at the endmost portion of the band.

5. An inkjet recording method for effecting recording on a recording medium by a recording unit during a relative movement between the recording unit and the recording medium, the recording unit configured to discharge a small ink droplet and a large ink droplet larger than the small ink droplet, the large ink droplet and the small ink droplet being the same color, comprising:

counting a number of discharge data for discharging ink droplets to be used for forming a band to be recorded by the recording unit during one relative movement;

determining whether or not to perform a process for replacing discharge data for discharging at least one of the small ink droplets to be used for forming at least one raster positioned at an end portion of the band with discharge data for discharging at least one large ink droplet, according to a count value obtained by the counting step; and discharging at least one of the small ink droplet and the large ink droplet from the recording unit based on a determining result obtained in the determining step.

6. The inkjet recording method according to claim 5, wherein if the count value exceed a predetermined threshold, it is determined by the determining step that the process is performed, and if the count value does not exceed the predetermined threshold, it is determined in the determining step that the process is not performed.

* * * * *